US006328494B1

(12) United States Patent
Moxon

(10) Patent No.: US 6,328,494 B1
(45) Date of Patent: Dec. 11, 2001

(54) ERGONOMIC TOOL HOLDER OR WRITING TOOL WITH MEANS TO BE MOLDED TO FIT THE USER'S HAND

(75) Inventor: William A. Moxon, Greeley, CO (US)

(73) Assignee: Pengineering, LLC, Greeley, CO (US)

( * ) Notice: Subject to any disclaimer, the term of this patent is extended or adjusted under 35 U.S.C. 154(b) by 0 days.

(21) Appl. No.: 09/640,766

(22) Filed: Aug. 18, 2000

Related U.S. Application Data

(60) Provisional application No. 60/149,769, filed on Aug. 19, 1999.

(51) Int. Cl.[7] ..... B43K 23/004; B43K 23/008

(52) U.S. Cl. ..... 401/8; 15/443; 16/430; 206/224; 206/232; 206/234; 206/371; 206/374; 206/375; 401/6

(58) Field of Search ..... 401/6–8; 15/438–440, 15/443; D19/41; 16/430, 900, DIG. 12, DIG. 19; 206/232, 234, 224, 371, 372, 374, 375

(56) References Cited

U.S. PATENT DOCUMENTS

| | | | | |
|---|---|---|---|---|
| 485,440 | * | 11/1892 | Thornhill | 401/8 |
| 665,561 | * | 1/1901 | Anderson | 401/8 |
| 3,947,132 | | 3/1976 | Fox . | |
| 4,076,427 | | 2/1978 | Anderson . | |
| 4,076,428 | | 2/1978 | Otake et al. . | |
| 4,077,726 | | 3/1978 | Hechtle . | |
| 4,227,823 | * | 10/1980 | Kitzerow | 401/6 X |
| 4,269,529 | | 5/1981 | McCollough . | |
| 4,523,781 | | 6/1985 | Brody . | |
| 4,606,484 | | 8/1986 | Winter et al. . | |
| 4,617,697 | * | 10/1986 | David | 16/DIG. 19 X |
| 4,738,556 | | 4/1988 | Brown . | |
| 4,906,119 | | 3/1990 | Hartford et al. . | |
| 4,932,800 | | 6/1990 | Lin et al. . | |
| 4,934,024 | * | 6/1990 | Sexton, I | 16/DIG. 12 X |
| 5,000,599 | * | 3/1991 | McCall et al. | 401/6 |
| 5,143,463 | | 9/1992 | Pozil et al. . | |
| 5,155,878 | * | 10/1992 | Dellis | 16/DIG. 12 X |
| 5,180,239 | | 1/1993 | Bristrack . | |
| 5,181,531 | | 1/1993 | Escoto et al. . | |
| 5,228,794 | | 7/1993 | Hochstetler . | |
| 5,314,260 | | 5/1994 | Andersson . | |
| 5,399,041 | | 3/1995 | Chiswell . | |
| 5,405,206 | | 4/1995 | Bedol . | |
| 5,470,162 | | 11/1995 | Rubin . | |
| 5,527,124 | | 6/1996 | Kolaric . | |
| 5,529,415 | | 6/1996 | Bishop . | |
| 5,620,090 | * | 4/1997 | Beeley | 206/234 |
| 5,626,430 | | 5/1997 | Bistrack . | |
| 5,662,423 | | 9/1997 | Walden . | |
| 5,692,236 | | 12/1997 | Prince . | |
| 5,722,575 | | 3/1998 | Smith . | |
| 5,785,443 | | 7/1998 | Rubin . | |
| 5,791,705 | | 8/1998 | Romero et al. . | |
| 5,867,912 | | 2/1999 | Hickok et al. . | |

(List continued on next page.)

OTHER PUBLICATIONS

Undated advertisement for "Ring Pen".

*Primary Examiner*—Gregory L. Huson
*Assistant Examiner*—Kathleen J. Prunner
(74) *Attorney, Agent, or Firm*—James K. Poole, Esq.

(57) ABSTRACT

A tool holder or writing instrument is provided which includes a formable modeling compound material positioned around a flexible rod or tube which in a preferred embodiment is capable of holding an ink or other writing substance. The material is capable of conforming to the fingers and grip orientation of a user of the writing instrument to provide a comfortable, ergonomically correct writing instrument. Additionally, a portion of this writing instrument (e.g., the flexible tube) may be wrapped around at least one digit of the user's writing hand, e.g. the index finger, to provide additional support and comfort. One end of the tube can include means for removably attaching various hand tools such as scribes, knives, electrical contacts or the like.

36 Claims, 19 Drawing Sheets

U.S. PATENT DOCUMENTS 5,868,509 2/1999 Crutcher .
5,876,134 * 3/1999 Tseng et al. ..... 401/6
5,885,018 3/1999 Sato .
5,885,020 3/1999 Rossi .
5,893,671 4/1999 Bellue .
5,906,705 5/1999 Chung et al. .
5,971,642 10/1999 O'Mara et al. .
6,029,816 * 2/2000 Goodwin et al. ..... 206/371
6,036,385 3/2000 Bistrack .
6,158,910 * 12/2000 Jolly et al. ..... 401/6

* cited by examiner

ROD
10
13
19
35
39
21
31
25
16
STYLUS
TOOL
AS
EXAMPLE
19

ERGONOMIC TOOL HOLDER OR WRITING TOOL WITH MEANS TO BE MOLDED TO FIT THE USER'S HAND

REFERENCE TO RELATED APPLICATION

This application claims priority from Applicant's Provisional Application U.S. Ser. No. 60/149,769, filed Aug. 19, 1999.

FIELD OF THE INVENTION

This invention relates to tool holders and writing instruments, and more specifically tool holders or writing tools which can be individually molded to perfectly and uniquely fit each user's hand.

BACKGROUND OF THE INVENTION

Various types of hand tools and writing tools have typically been mass-produced, and therefore by necessity are manufactured in one universal size. Thus, the philosophy that "one size fits all" has been paramount throughout the industry. The problem is that not everyone's hands and fingers are the same size, and further, not everyone grips a hand tool or writing tool in the same manner. The relative positioning of each finger on a writing tool can vary widely from person to person, thus causing extreme discomfort, writing cramps and numerous other ailments as a result of repeated use with the wrong sized writing instrument. Having an ergonomic grip would also be desirable for hand-held tools in general, especially for tools which are employed for long periods of time of repetitive use and require precision in their use.

In recent years, many people have recognized the need for a more comfortable writing tool, and all developments addressing this need can be grouped into two types, many of which have been patented. The first group of writing instruments are characterized by an attachment piece which slides over the barrel of a conventional pen or pencil. For example, U.S. Pat. Nos. 5,662,423 and 4,932,800 were designed for this particular purpose. U.S. Pat. No. 5,143,463 discloses a writing aid designed to slip over a writing instrument, with grooves provided to accomodate the thumb of either right-handed or left-handed users. These inventions were designed to increase the comfort level of a standard writing tool. Some of these devices are made out of a pliable material like foam rubber or silicone but without exception they are mass-produced to again be a one-size-fits-all scenario, and therefore the one universal size cannot truly fit everyone's unique hand size and grip perfectly. Additionally, simply providing a layer of pliable material upon the gripping portion of the tool will not significantly reduce the level of fatigue and tension many people experience with grasping a tool for extended periods of work time. What is required is a tool grip which can be initially conformed to the individual user's grip, but once formed, can be "set" to a semi-rigid shape. The grip shape will now truly support and partially surround or envelop the tool user's fingers to the degree that the user does not need to exert any force to grasp the tool. The user can then merely guide the tool to perform its intended task.

The second approach taken to provide a more comfortable writing instrument has been to deviate from the typical straight-tube design most writing tools employ and to incorporate a non-linear curved shape. Samples of these types of products are seen for example in U.S. Pat. Nos. 4,076,427, 5,527,124, 5,228,794, 5,893,671, 5,785,443, 5,314,260 and 5,529,415. Some pens have a built-in kink or indentation on the pen shaft so as to fit the human hand more comfortably. U.S. Pat. No. 4,906,119 discloses a handwriting stabilizer including a stabilizer bar and a curved gripping section to hold a curved ink cartridge. An articulated joint between these two sections permits various adjustments. Body 12 of the stabilizer can be of plastic, heat-molded only for the desired angle. The problem with all the prior art of this second approach is the same as the attachable devices of the first type. That is, they are mass produced in only one size and only one generic finger grip orientation, which again does not allow an individual to have a custom fit writing tool. Thus, it would be extremely beneficial to provide a writing instrument which is custom made to uniquely fit the hand and finger size of each individual user.

A few improved tool holders have been patented. For example, U.S. Pat. No. 5,906,705 discloses a tool holding apparatus to assist in gripping hand-held tools. A hand-engaging portion slips around the palm and back of the hand, while a tool-receiving portion attaches thereto. The portion engaging the palm/back of the hand can be of plastic heat-molded to shape, and various tool connection means are shown. This device might help to support olr brace the attached tool, but no means are provided to comfortably provide support for the finger tips to allow the fine motor control required to use most pens and similar hand tools effectively. This patent is incorporated herein by reference in its entirety.

The following patents disclosing tool holders or writing instruments employ some type of strap to fasten a tool to the user's finger or hand:

U.S. Pat. No. 5,722,575 discloses a grip-assisting accessory with a sleeve to fit various tools and a VelcroR strap attached to secure same to a finger.

U.S. Pat. No. 5,971,642 claims the product design shown in U.S. Pat. No. D389,185. The patent discloses a writing instrument with a finger retainer which is adjustable; Velcro straps can also be used.

U.S. Pat. No. 5,405,206 discloses a finger-mounted writing apparatus with a support ring (which could be of rubber) for securing the unit to a finger. The writing device can include a highlighting pen or other writing implement.

U.S. Pat. No. 5,868,509 discloses a holder for a writing instrument which can be worn atop the index finger while the user is doing other work, and can include a Velcro securing strap.

U.S. Pat. No. 4,738,556 discloses a finger pen with padded attachments and a Velcro strap for securing the unit to the finger. A ball point pen refill can be coiled inside the holder.

Despite all these products in the prior art, a need clearly exists for tool holders and writing instruments which can be custom fitted to a user's own grip, to facilitate use by youngsters, the elderly and the disabled. There still does not exist a tool which by design is extremely adaptable to truly fit and support any individual's unique grasping technique, as well as hand and finger size, for writing instruments and hand tools typically grasped in a similar manner.

SUMMARY OF THE INVENTION

It is thus an object of the present invention to provide a tool holder or writing instrument which is custom fitted for an individual's distinct hand size and finger positioning during use. Thus, the tool holder or writing instrument can be custom fitted for children, adults, the handicapped and physically challenged to provide a tool which is ergonomically correct and prevents excessive hand and finger fatigue during use.

It is a further object of the present invention to provide a method for making a tool holder or writing instrument which is inexpensive, easy to implement and which can be understood even by small children. Additionally, it is preferred that a variety of colors and materials be employed to allow an individual to customize the tool holder or writing instrument for their own particular design with various ornamental features.

It is yet another object of the present invention to utilize certain materials which may allow the implement to be remakeable or rebuildable. Thus, if a user is uncomfortable with the present fitting of the tool holder or writing instrument, the modeling compound, plastic or polymer material may be removed or re-shaped to allow a new grip to be formed.

In yet another aspect of the present invention, it is intended that the tool holder or writing instrument can be produced and sold to the end-user with the objective that the writing instrument be final-molded by the end-user to perfectly and uniquely fit that person's hand size and finger grip orientation. Thus, the end user can enjoy the benefit of a custom fit from a tool holder or writing instrument which has the functional and ornamental features unique to the individual creation.

Still another object of the present invention is to provide tool holders and writing instruments with a component comprising a bendable rod or tube which is bent into a loop which can be adjusted to accomodate at least one digit of the user's writing hand, with the effect of supporting the tool holder or writing instrument so that the user can concentrate effort on the fine motor skills necessary to guide the tool or writing instrument in use.

In accordance with the invention, a custom-fitted tool holder is provided which comprises a substantially longitudinal bendable rod having a first end and a second end; means for attaching a tool, interconnected (preferably removably) to the first end of this rod; and a piece of formable modeling compound positioned between the first and second ends of the bendable rod, adapted for conforming to the shape and size of a user's fingers and grip orientation, and then hardened. The second end of the bendable rod can contain a loop shape adapted for wrapping around at least one digit of the user's writing hand, such as the index finger. Surprisingly, the modeling compound formed to custom fit the user's grip orientation and the bendable rod or tubing which is looped about at least one digit of the user's writing hand can be used to advantage independently, as discussed below.

Various hand tools such as writing sources, scribes, styluses, knives, surgical and dental instruments, applicators for paint or cosmetics, thermal devices such as soldering irons, electrical contacts and the like can be removably attached to the tool attachment means at the first end of the flexible tubing material. In a preferred embodiment, the tool holder comprises a writing instrument such as a pen or pencil, which may be permanently attached. The rod can be replaced by a flexible tubing material, for instance, which can comprise a conventional ball-point pen refill which becomes an integral part of the writing instrument.

Such writing instruments are preferably produced and marketed as a kit for assembling and fitting a custom-fitted writing instrument, the kit comprising:

a substantially longitudinal flexible tubing material having a first end and a second end;

a writing source positioned inside the flexible tubing material and interconnected to a writing tip which extends beyond the first end of the flexible tubing material for contact with a writing surface when assembled;

a piece of formable modeling compound sufficient for positioning at least one portion between the first and second ends of the flexible tubing material and molding for adaptation to the size, shape and grip orientation of a user's fingers;

containment means for the modeling compound;

packaging means for shipment, display and sale of the kit; and instructions for assembling the writing instrument and molding the modeling compound into a shape adapted to fit the user's fingers and grip orientation.

With some modeling compounds, it may be necessary to provide containment means which exclude air. In a preferred embodiment, the kit package can provide a carrying case for the completed writing instrument.

Such kits can also be produced for tool holders, preferably using a bendable rod rather than tubing, attachment means for tools, and optionally, at least one tool to be removably attached to the attachment means.

Further in accordance with the invention, a method for creating a custom-fitted tool holder or writing instrument comprises the steps of:

providing a bendable rod or flexible tubing material having a first end and a second end, with either means for removably attaching a hand tool or a writing source interconnected to a writing tip positioned at the first end;

shaping a piece of formable modeling compound around the rod or tubing material in a manner which custom fits the moldable compound to the fingers and grip orientation of a user of the instrument while in a position of use; and hardening the formable compound to a degree which prevents the formable compound from permanently deforming during use of the instrument.

Additional objects and advantages of the present invention are described in, and will be apparent from, the following detailed description of preferred embodiments together with the drawings and the appended claims.

BRIEF DESCRIPTION OF THE DRAWINGS

FIG. 2 is a side exploded view of the tool attachment means shown in FIG. 1.

DETAILED DESCRIPTION OF THE PREFERRED EMBODIMENTS

Figure 1:
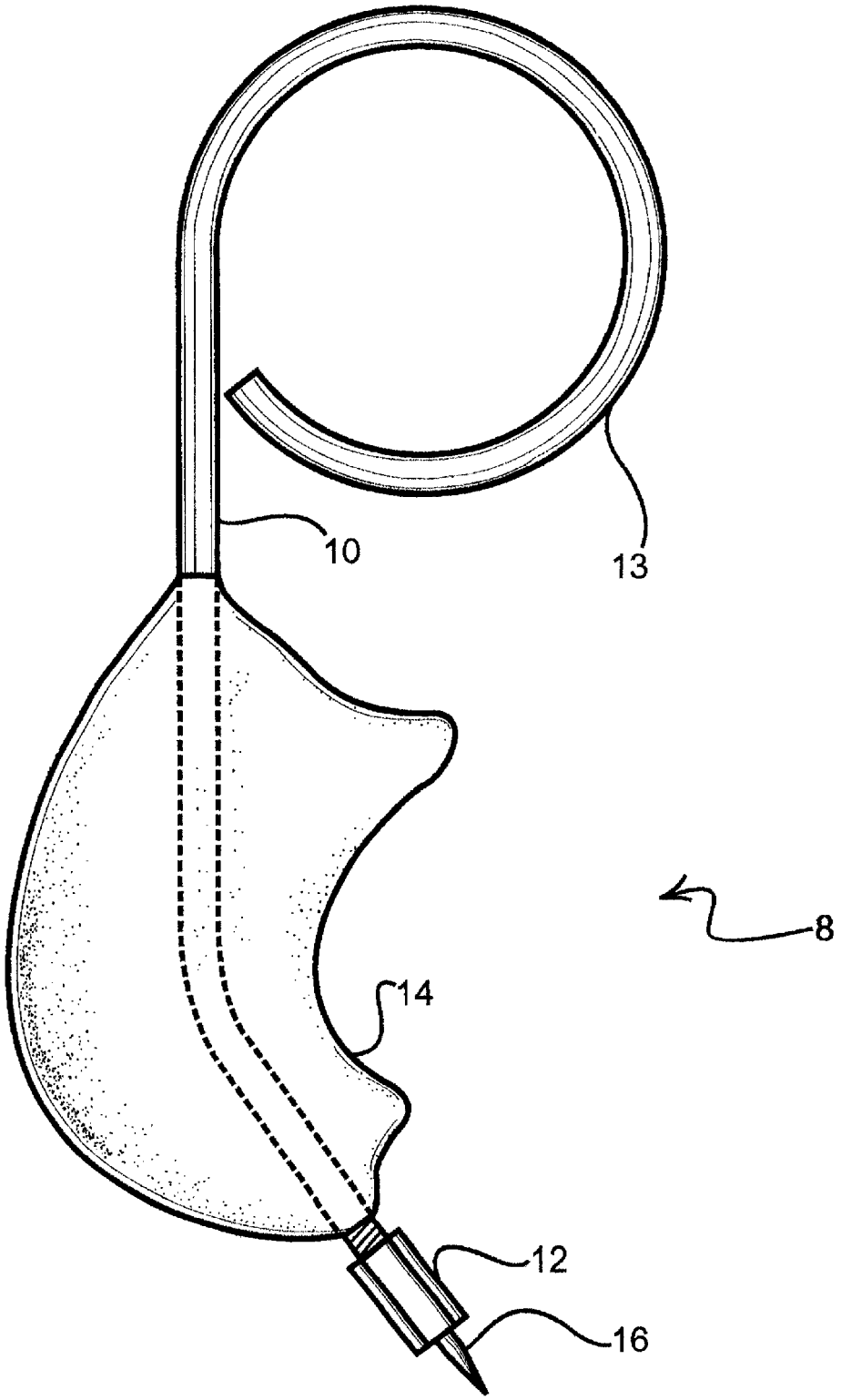
FIG. 1 is a side view of a custom-fitted tool holder of the present invention.

Referring now to the drawings, a typical embodiment of a completed tool holder 8 is illustrated in FIGS. 1 and 2. Further details are shown below in the illustration of a preferred embodiment which comprises a writing instrument such as a pen. Bendable rod 10 serves as a support for tool attachment means 12, which is attached to one end of the rod. Rod 10 can be a metal such as copper, aluminum or steel, or alloys thereof, and can be bent into shapes to fit the user's grip and retain this shape. Rod 10 can be of solid material, at least partially hollow, or take the form of a tube, as described below in reference to other embodiments. Applicant adopts the word "bendable" to signify materials which can be bent into different shapes and retain such shapes unless further pressure is applied. Alternatively, rod 10 can be made of a thermoplastic polymer material which can be formed after heating and hardened to a stable position when cooled. Thermoplastic rods may permit repeated adjustments in shape.

Tool attachment means 12 can be permanently attached to rod 10 by welding, brazing, soldering or adhesives, but is preferably removably attached to the rod by threads, set screws, frictional press-fit or the like, so that different tool attachment means can be attached and used. Rod 10 can optionally be bent near the attachment end to support the tool employed in a preferred position during use (as shown below). The exterior of rod 10 is preferably scored or knurled to provide a superior bonding surface for the molded grip 14, which is more fully described below. Rod 10 is generally straight on its end opposite attachment means 12, and optionally the straight end slides into finger support housing 13. This slip fit of rod 10 into finger support housing 13 allows for the overall length of the tool holder 8 to be adjusted by the user to perfectly fit the user's hand and grip orientation. Finger support housing 13 is bent to form a loop which will provide satisfactory support to at least one digit of the user's writing hand when the molded grip is grasped in a comfortable position. Alternatively, rod 10 and finger support housing 13 may be the same integral rod or tube.

While flexible tubing material can be used in the preferred pen embodiment described below, with the tubing even serving as a ballpoint pen ink reservoir or receiving a standard ballpoint pen refill, in many cases it will be preferred to use a solid rod for the tool holder 8, to facilitate threading to accomodate the tool attachment means and permit repeated bending to adjust the tool holder to different grips for multiple users or tools.

Figure 3:
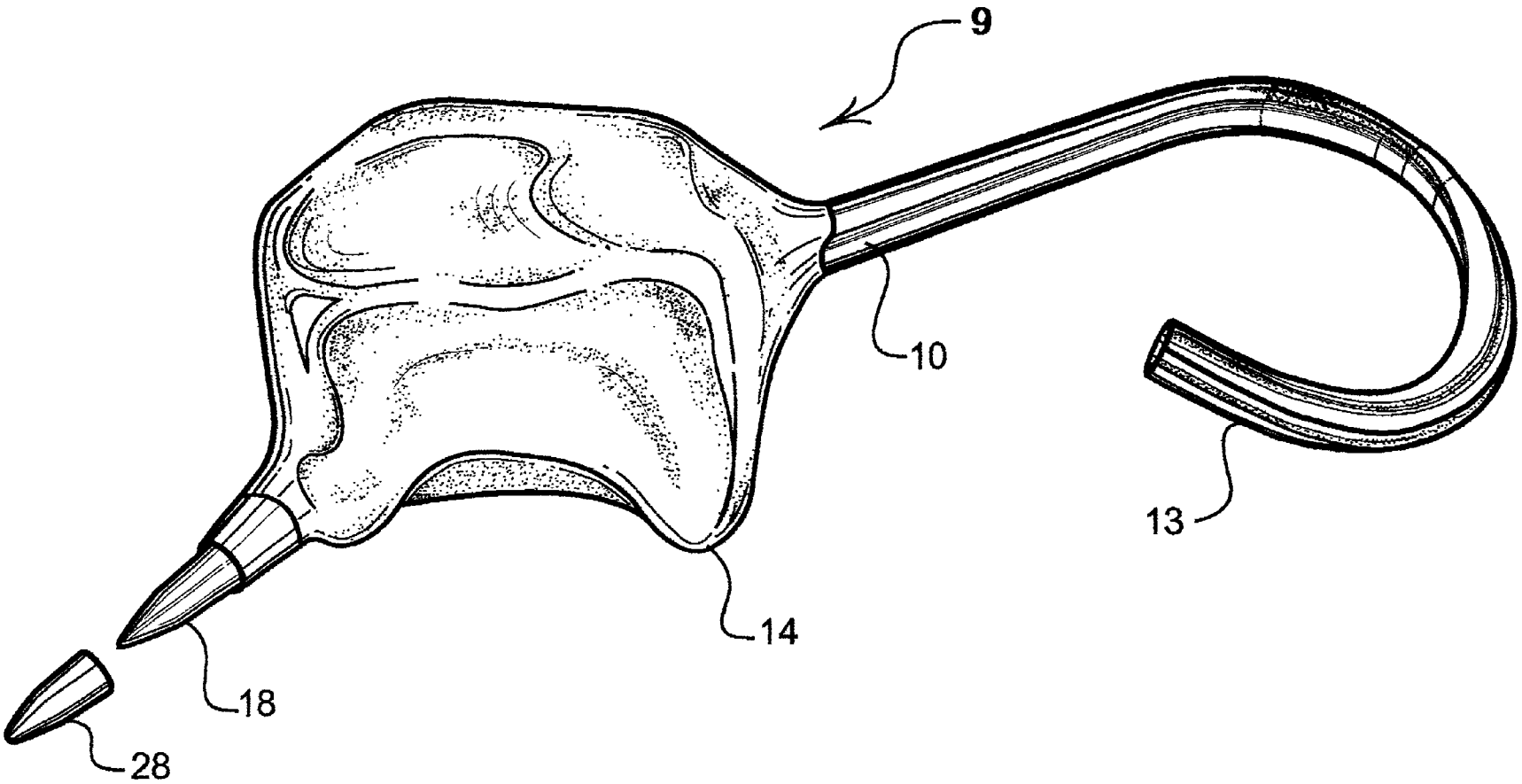
FIG. 3 is a front perspective view of a writing tool embodiment of the present invention.
Figure 3A:
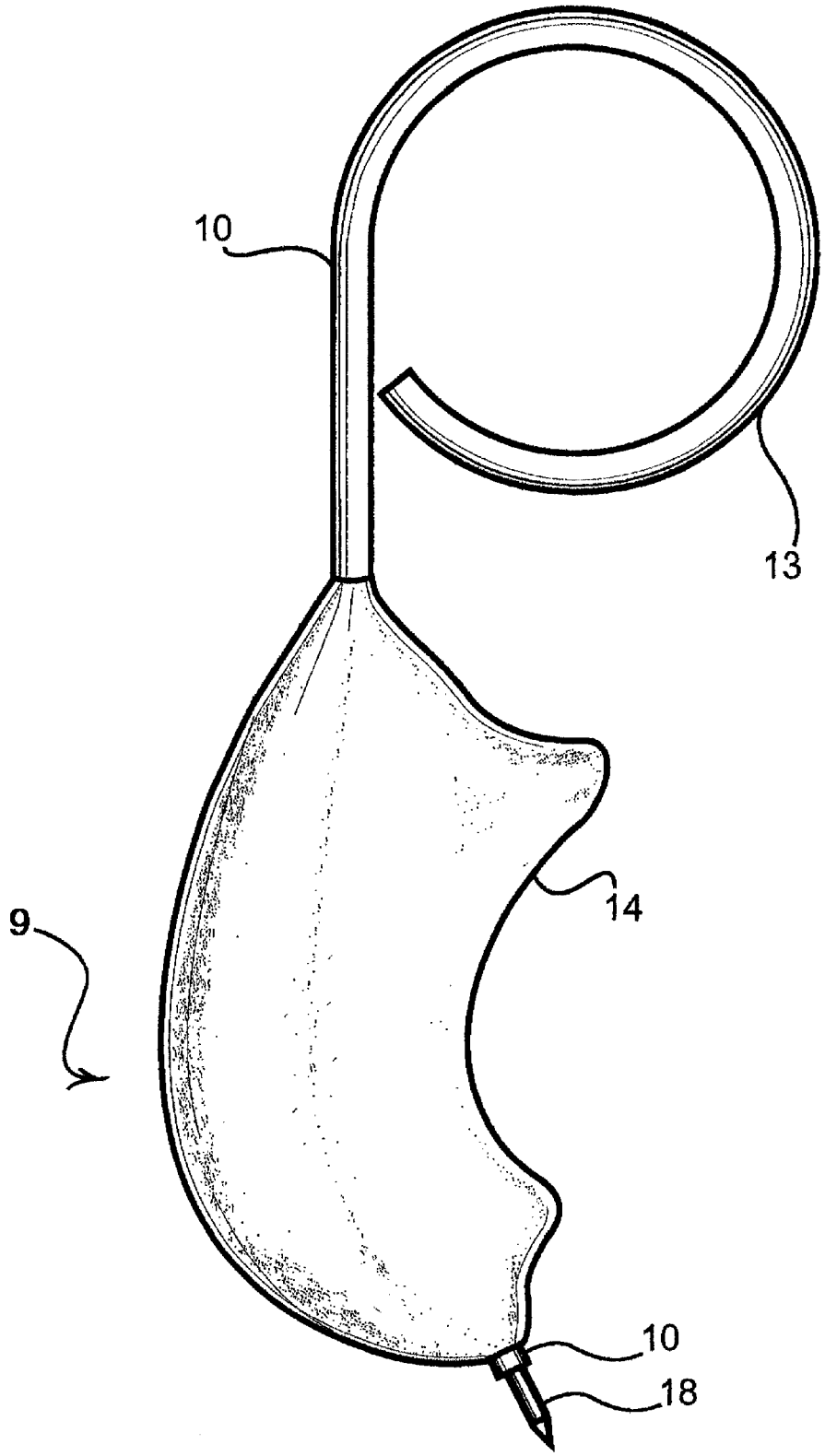
FIG. 3A is a side view of the tool of FIG. 3.

As described below for the preferred pen embodiment, the tool holder 8 is custom fitted to the user's fingers, hand and grip orientation by the use of a formable piece of a modeling compound. The molded finger grip 14 is shown detail in FIGS. 3 and 6.

A variety of tool attachment means 12 can be employed, to accomodate a wide variety of tools for use with the custom-fitted tool holder 8. Such tool attachment means for small hand tools are well known in the art, e.g. the X-Acto® series of holders or handles for various hobby knives and the like. Exemplary tool attachment means are disclosed in U.S. Pat. No. 5,867,912 (blade mounting swivel head), U.S. Pat. No. 5,405,206 (replaceable highlighter mount), U.S. Pat. No. 5,868,509 (frictional sleeves and the like), U.S. Pat. No. 5,791,705 (grooves and elastic bands; recess with frictional fit; and threaded couplings), and U.S. Pat. No. 4,906,109 (frictional sockets, horizontal or vertical). All these patents are incorporated herein by reference.

The tool attachment means 12 shown in FIGS. 1, 2, 2A, 2B and 2C is a tool collet assembly which comprises a collet receiver component 19 which attaches to rod 10 by mechanical means, preferably removably, such as, e.g. threads. The end of the collet 21 which receives the tool is slit laterally at receiving end 31 to a depth sufficient to receive various tool bits which may be provided with a flat strip for mounting therein, and/or with a hole to receive a shaft-type mounting. Although this hole is shown as round in FIG. 2B, it may be any suitable shape adapted to receive the shafts of tool bits to be used with the holder. Collet 21 fits into the hole 39 at the end of collet receiver 19, and collet sleeve 25 can be screwed onto collet receiver threads 35 to exert pressure on the split end of collet 21. When a tool such as stylus 16 is inserted into collet 21 and collet sleeve 25 is screwed tight onto collet receiver threads 35, the shaft of tool 16 will be firmly gripped therein. Many other configurations of collet-type tool holders are possible in this context, and another is described below. For such small tools, any suitable collet-type tool holder means can be used effectively.

Figures 2A, 2B, 2C:
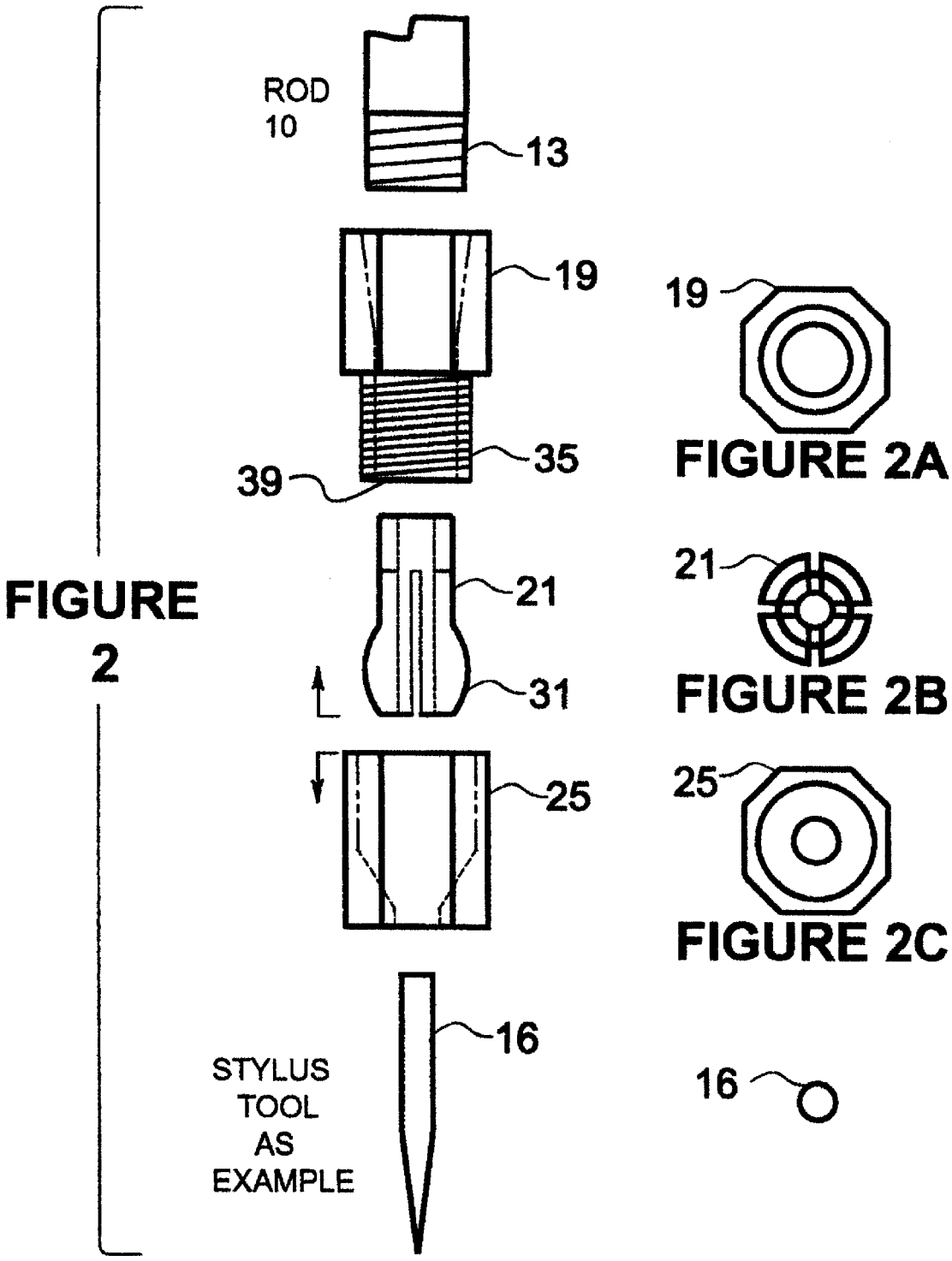
FIG. 2A is an end view of the collet receiver component of FIG. 2.
FIG. 2B is an end view of the tool collet component of FIG. 2.
FIG. 2C is an end view of the collet sleeve component of FIG. 2.
Figure 2D:
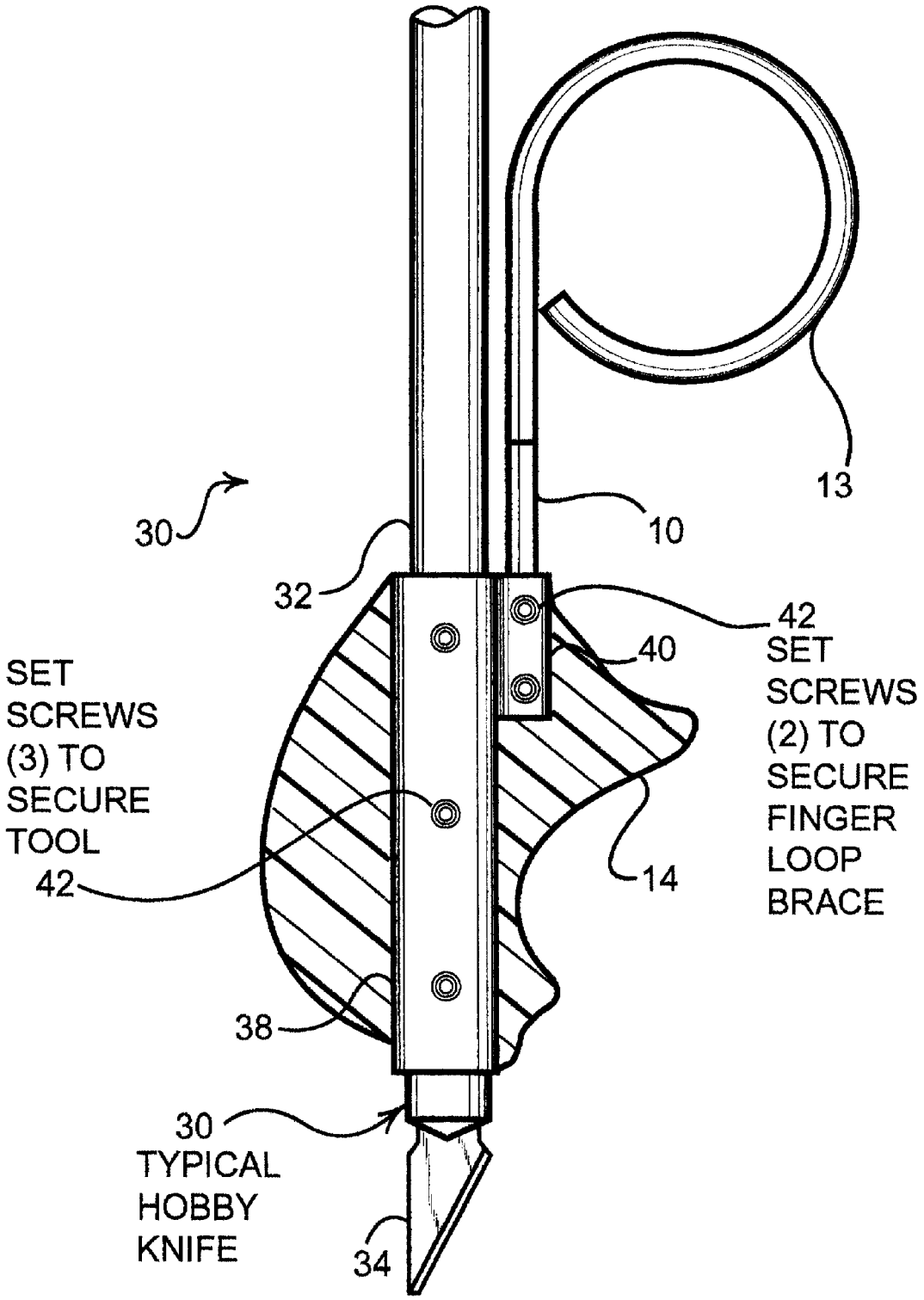
FIG. 2D is a side view of a tool holder of the present invention configured to grip the handle of a small hand tool.
Figure 2E:
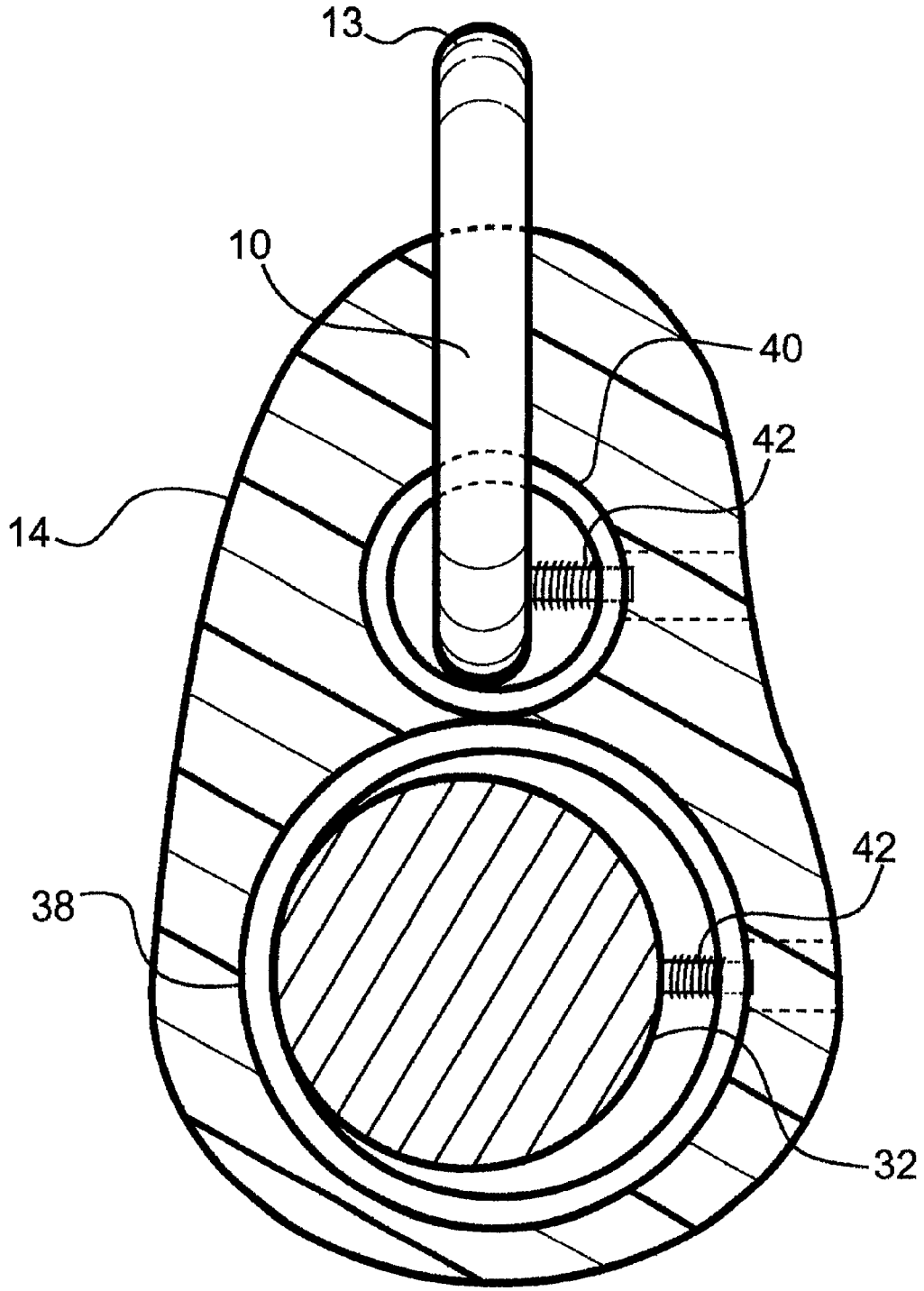
FIG. 2E is a sectional view of the attachment means used in the tool holder of FIG. 2D.

The embodiment shown in FIGS. 2D and 2E comprises two interconnected tubular members 38 and 40, each containing holes to receive setscrews 42. The smaller tube 40 slips over rod 10 of the tool holder and is secured by tightening set screws 42, which can be conventional short Allen head machine screws. A small hand tool such as the hobby knife 30 shown has a handle 32 and a blade 34. The handle 32 is inserted into tube 38, adjusted to provide the proper length for the user's grip and tasks to be performed, then fastened removably in place with setscrews 42. The formable modeling compound is then formed around the resulting attachment means to form a custom-fitted grip 14 and is hardened to form a permanent grip. It is preferable to form holes in the formed modeling compound (not shown in this view) prior to hardening to afford later access to the setscrews with an Allen wrench or screwdriver for adjusting the tool's position or removing the tool.

FIG. 2E shows tubes 38 and 40 permanently fastened together side to side. Depending upon whether the tubes are metal or plastics of various sorts, the tubes can be fastened together by any suitable method, including welding, brazing, soldering and adhesives. As an alternative to set screws, tube 38 can be slit longitudinally in at least one area adjacent to the tool (e.g., knife blade 34) and tightened on the tool handle 32 by a compressive device similar to a hose clamp (shown in FIG. 13). FIG. 2E also shows how tube 38 and rod 10 are held in place by setscrews 42. Clearly a wide variety of hand tools and writing instruments can be fastened to this embodiment of the tool holder.

Figure 2F:
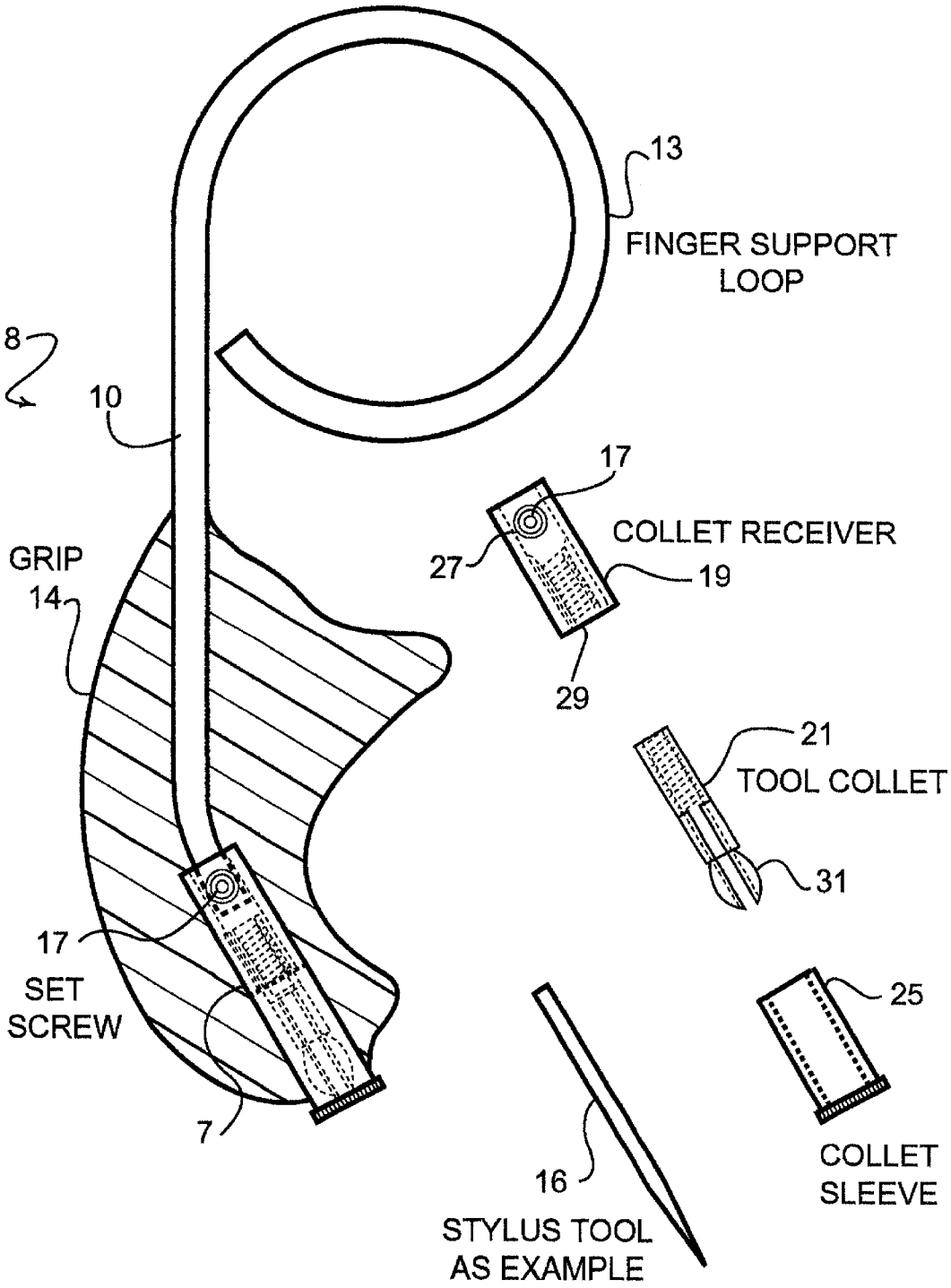
FIG. 2F is a side sectional view of a tool holder employing a tool collet which is buried within the grip.

In other embodiments, tool attachment means 12, whether detachable or permanent, is placed inside the custom-fitted grip 14. If it is necessary to remove and replace such attachment means, it can be removed from within the grip or the grip can be removed and replaced after the attachment means is replaced. FIG. 2F illustrates a tool holder of FIG. 1, modified to incorporate a tool collet inside the grip to minimize the length of the tool when attached. Tool collet 7 is attached to rod 10 with set screws 17, threads or any other suitable mechanical connection. Collet receiver 19 contains a threaded hole 27 to receive the set screw 17 and another threaded hole 29 bored longitudinally into the barrel of the receiver to receive the tool collet 21. Tool collet 21 has a split end 31 adapted to receive the shafts of various tools, and collet sleeve 25 fits over collet 21. As collet sleeve 25 and tool collet 21 are rotated into threads 29 of collet receiver 19, the split end 31 of tool collet 21 is compressed and grips the shaft of a tool inserted therein, such as stylus 16. While the tool collet shown has a substantial length which makes it practical to fasten it to rod 10 within the grip 14, more compact collets can be attached to the protruding end of rod 10 to provide suitable arrangments for the tool holder. Normally the tool collet will be fastened to rod 10 before the grip is formed and hardened. To afford access to set screw 7 after the grip is formed, a hole should be provided to expose the set screw(s) before the grip is hardened. This technique is discussed in more detail below.

Figure 2G:
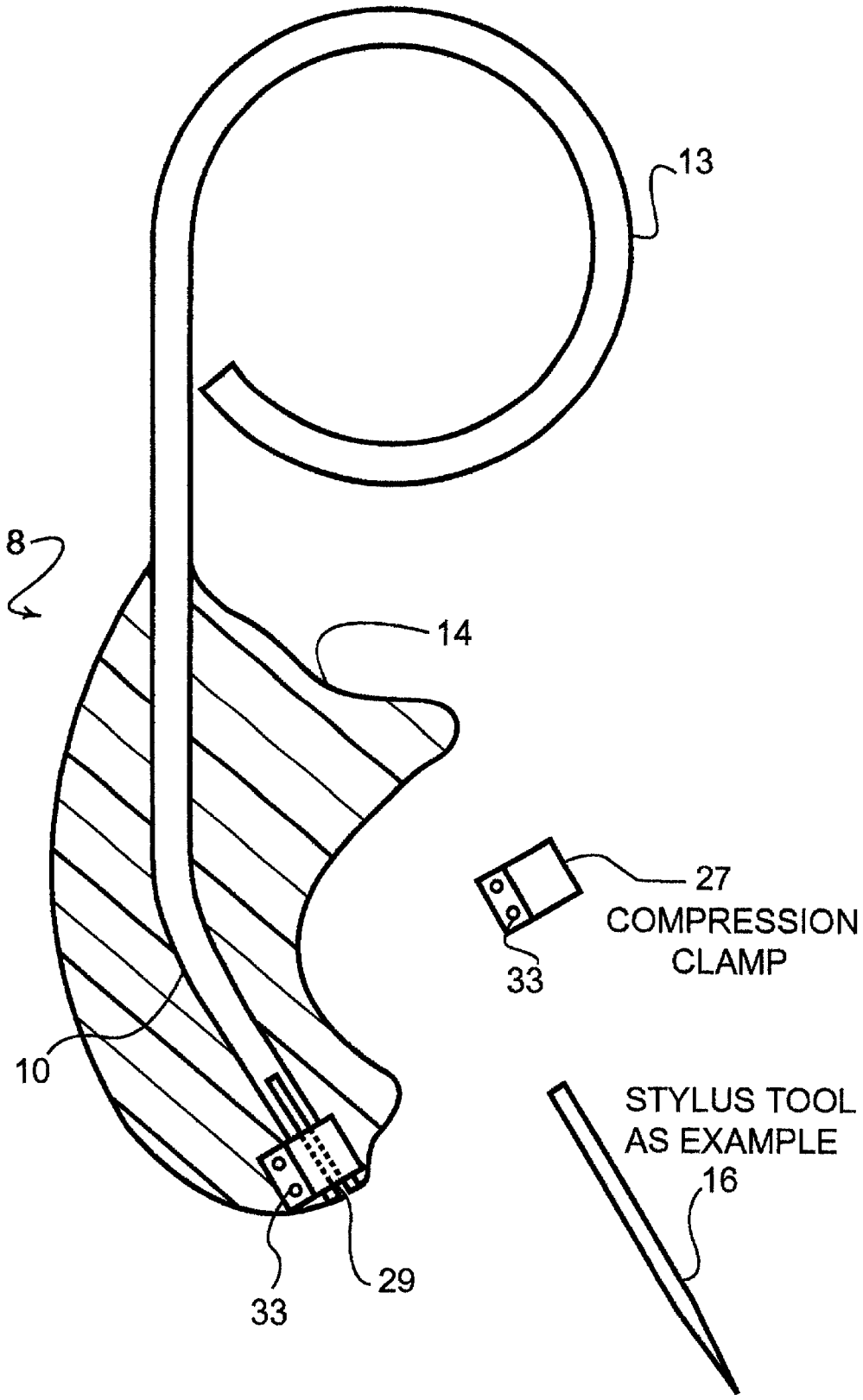
FIG. 2G is a side sectional view of a tool holder employing a compression clamp which is buried within the grip.

FIG. 2G illustrates an integral and permanent tool attachment means incorporating part of rod 10. Rod 10 is cut to provide slit 29 at the attachment end and compression clamp 27 is designed to fit over the split ends of rod 10. Once a tool such as stylus 16 is inserted into the slit, compression clamp 27 can be tightened with bolts 33 to compress the split ends of rod 10 and hold the tool tightly. As described above, compression clamp 27 must be installed before the grip is applied and formed, and holes providing access to set screws 33 should be provided before the grip material is hardened. Compression clamp 33 has a generally round or oval cross section to fit over the split ends of rod 10.

A variety of suitable small hand tools can be used in the tool holders described above. The custom-fitted grip is designed to improve the user's fine motor control, so as to permit more precise work on small scale projects and/or to improve the performance of users who lack sufficient motor control to otherwise use such a tool. For example, the tool can be various sorts of knives, chisels and other cutting tools; surgical and dental instruments; scribes and other tools for scoring or cutting metal; styluses for marking upon the screens of computers and other electronic devices such as "personal digital assistants"; burnishing tools; brushes, airbrushes or other applicators for applying paints, stains, cosmetics or other marking materials; probes or electrodes for making electrical contact with electrical circuits or other apparatus; various marking media; and heated tools such as soldering irons, miniature torches or wood-burning tools.

Figure 3B:
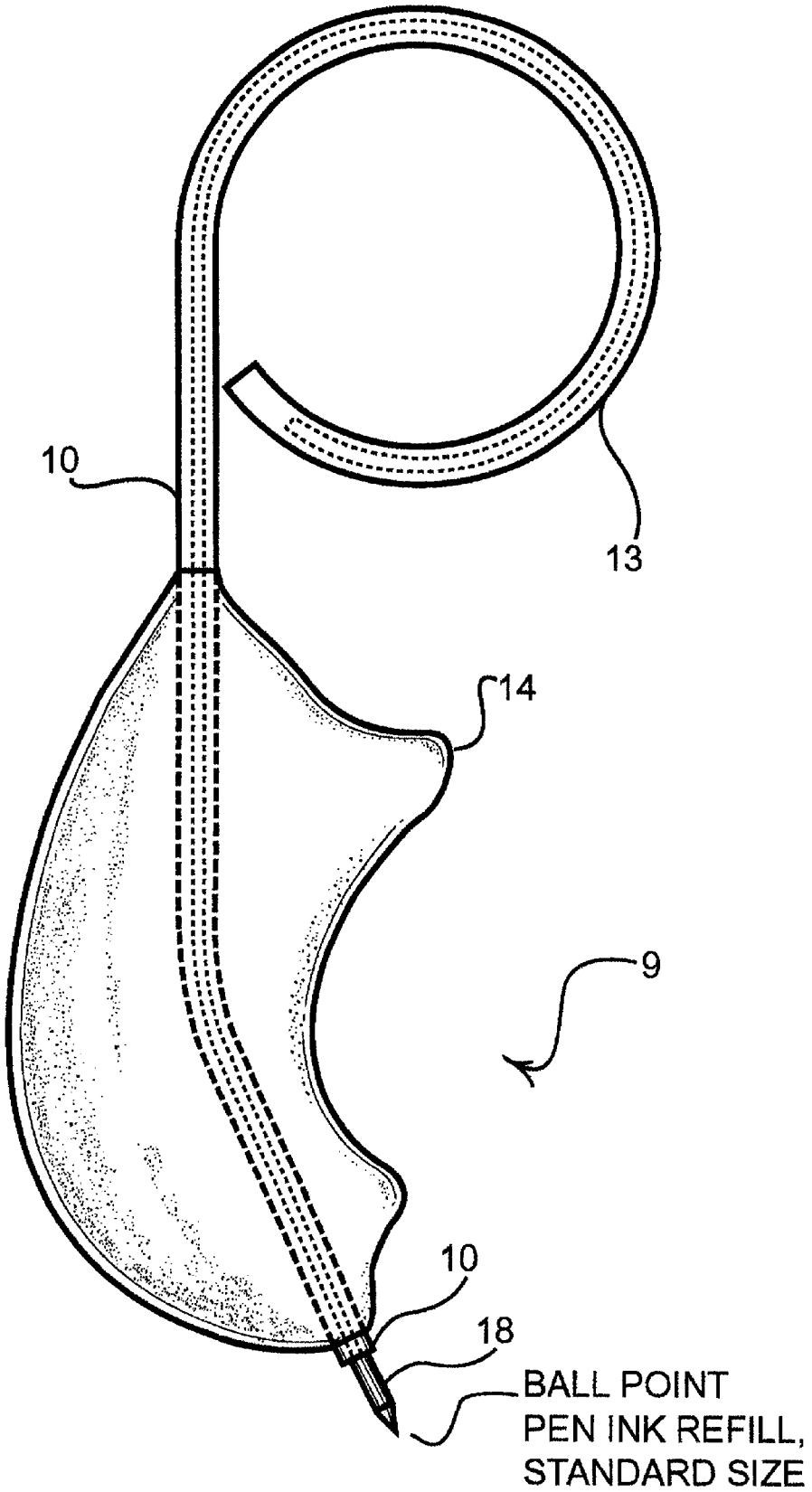
FIG. 3B is a side phantom view of the tool of FIG. 3 showing the placement of a ballpoint pen refill inside the tube 10.
Figure 4:
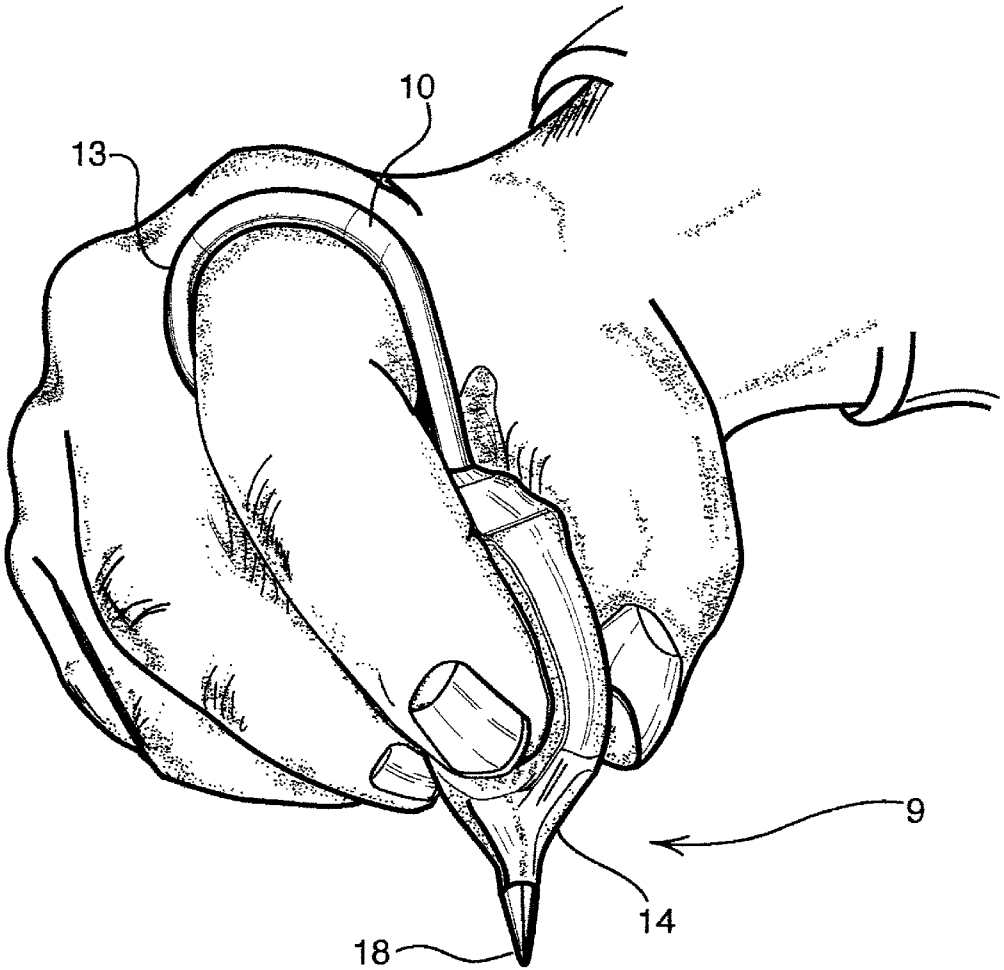
FIG. 4 is a front perspective view of the invention shown in FIG. 3 in actual use positioned in a user's hand.
Figure 5:
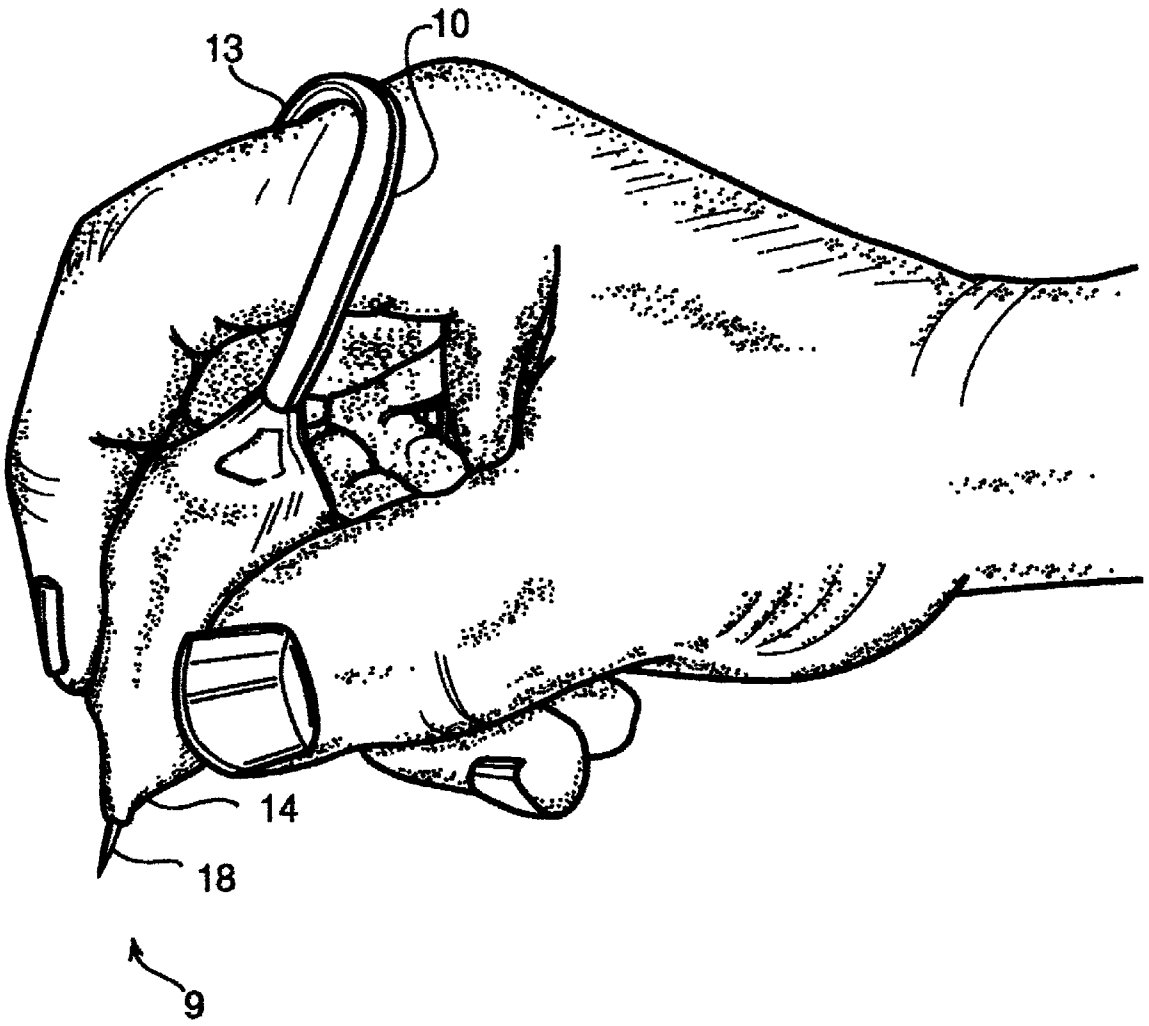
FIG. 5 is a side perspective view of the invention shown in FIG. 3 in actual use positioned in a user's hand.
Figure 6:
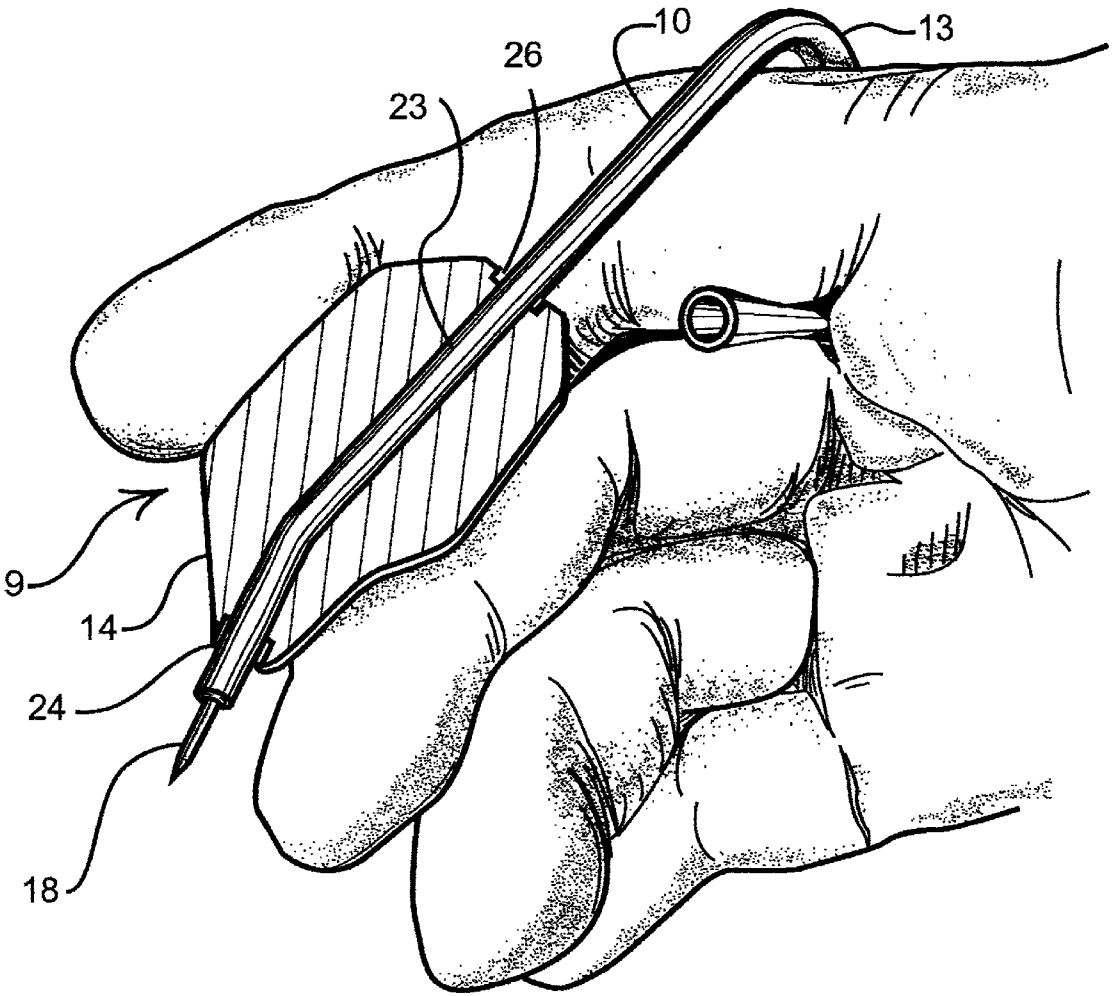
FIG. 6 is a partial cutaway view of the invention shown in FIG. 3 positioned in a user's hand.
Figure 7:
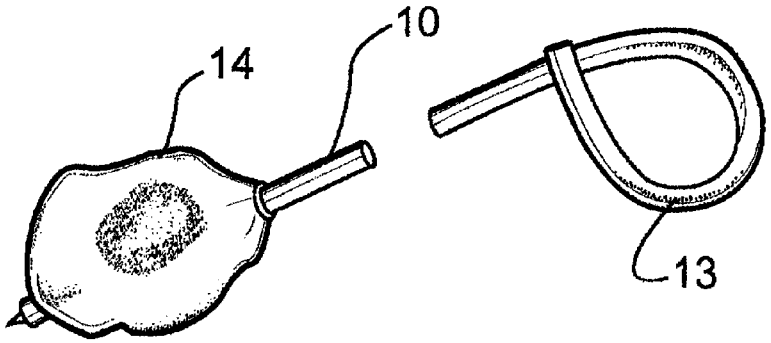
FIG. 7 is a top perspective view of the writing instrument shown in FIG. 3 with the components partially disassembled.
Figure 8:
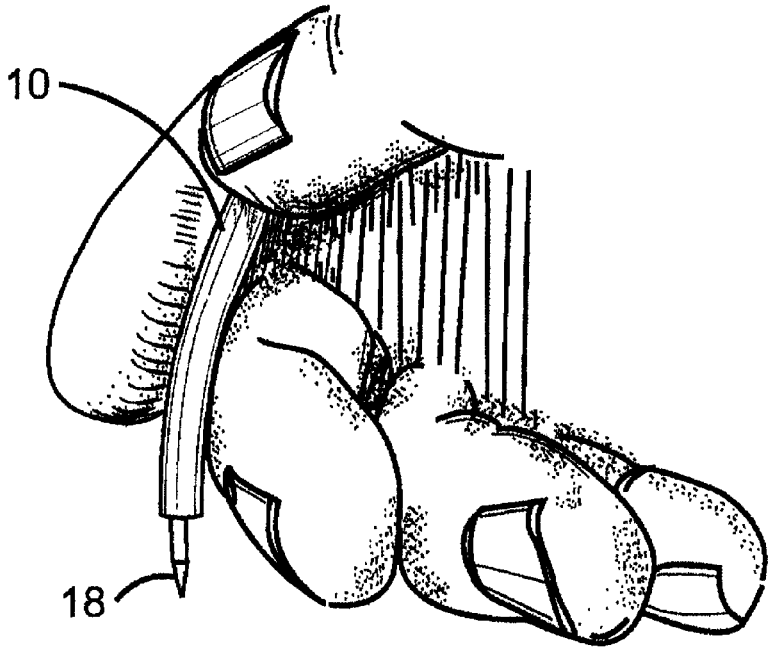
FIG. 8 is a front perspective view of the writing tip used in the invention of FIG. 6 and showing an angle of the writing tip relative to a user's hand.

The writing tool 9 of the present invention is illustrated in FIGS. 3–8. The tool generally has a tube 10 which supports the writing tip 18. Tubing is used in preference to solid or hollow rods as described above for the generic tool holder because it facilitates the use of various writing components, as will be described. Tube 10 may optionally be slightly bent as shown in FIGS. 3B, 6 and 8 so as to support the writing tip 18 in a more perpendicular orientation to the writing paper when the pen is in use. Such a position is preferred with ballpoint pens, for example.

Tube 10 also serves to contain the ink reservoir or lead in the case of a pencil. Thus, the chamber within tube 10 must be in communication with the tip 18 supported by tube 10. The exterior of tube 10 is preferably scored or knurled in the area to be covered with modeling compound, as shown at 23 in FIG. 6, so as to form a superior bonding surface for the molded grip 14 which will be more fully described below. Tube 10 is generally straight on its end opposite tip 18 and the straight end slides inside the curved finger support housing 13. This slip fit of tube 10 into the finger support housing 13 allows for the overall length of the writing tool to be adjusted by the end-user to perfectly fit the user's hand. The o.d. of tube 10 and i.d. of housing 13 are chosen to provide a close fit so that the two components will remain in position during use. These components are shown disassembled in FIG. 7. Alternatively, the tube 10 and finger support housing 13 may be the same integral tube. In this case, the length of the overall pen body can be adjusted by rolling up or unrolling the looped end 13. Both tube 10 and housing 13 can be made of aluminum, steel, copper or alloys thereof, or various flexible plastics such as nylon or polypropylene.

The finger support housing 13 is generally straight along the distal end which fits over tube 10, but is preferably curved or looped in such a manner as to form a loop around the base of at least one digit (i.e., fingers and/or thumb) of the user's writing hand, e.g. the writer's index finger, as seen in FIGS. 4–6. This loop could be pre-formed in the finger support housing 13 by the manufacturer of the writing tool, but final-adjusted by the end-user to provide a custom fit to the writer's finger(s) and grip orientation. Alternatively, the finger support housing may be straight and adapted to allow additional decorative materials to be interconnected thereto Such a structure corresponds to a writing tool (or tool holder) having only the custom-fitted finger grip without the loop to support the user's fingers, which is shown and described below.

As seen in FIGS. 4–6, the writing instrument 9 is custom fitted to a user's fingers, hand and grip orientation by the use of a formable piece of modeling compound, clay, plastic or other similar material. By "formable" it is meant that the material can be shaped by pressure into a configuration which is reasonably stable until the material is hardened. The formable compound allows the user to create a custom-fitted grip that perfectly matches and supports the user's fingers when the tool is used. No two people have fingers with the same size or configuration, nor do they grip tools or pens in the same manner. This is particularly true with users who have hand or function disorders (e.g., with afflictions such as cerebral palsy, rheumatoid arthitis or the like) or injuries. No single procedure for shaping the grip can be prescribed. What is important is that the user provide impressions in the grip to accomodate the digits involved in the user's grip when the tool is grasped in the expected position of use. When first introduced to the concept of a moldable grip and the preferred accompanying finger loop support, a user may find that a modified grip will be more effective than that used with similar tools previously without the features of the present invention.

The raw materials to form the molded grip 14 would preferably be supplied to the end-user of the writing tool in his choice of various color combinations. The end-user would then mix the grip material colors together into a desirable color shade and/or pattern of his choosing and apply the material over and around tube 10. The end-user would then form or mold the material into the grip shape that most fully and effectively supported his fingers on the writing tool. The molded grip material would be composed of such a material that it could then be hardened into the final shape which fits the end-user's fingers and grip. Various modeling compositions can be used, including those comprising natural clays and those based upon synthetic polymers. The molded grip can be composed of a latex-modeling compound such as Model-Magic® by the Binney & Smith Company. Alternatively, materials such as Sculpey III®, FIMO®, or Sculpey Flex® could be used for substantially the same purpose. Another suitable material is Magic Clay®, imported from Korea by PRO ART® of Beaverton, Oreg. Some modeling compounds can be hardened by air-drying for 24 hrs. Alternatively, certain types of thermosetting clays may be hardened in an oven for 10–40 minutes at a temperature between about 200° F. and 400° F. and preferably about 375° F. The actual temperature and the time of heating is dependent on the exact composition of clay or compound used, but most of these compositions would be considered thermosetting. Some materials such as Magic Clay can be hardened by boiling the molded product in water for a time effective to harden the piece, usually for only a few (e.g., 3–5) minutes. When hardening by baking or boiling, caps should be in place at both ends of the tube to prevent any ink from escaping. With some assemblies, the ballpoint refill can be removed from the tool before hardening takes place. Hardening by boiling can produce a desirable rubbery or resilient surface consistency with certain molding compositions, which yields slightly to pressure, while the overall shape of the molded object remains stable.

Thermoplastic molding materials can also be used, by heating in a bath of hot water or sand and then molding to the desired shape before the material cools. Thermoplastic molding materials allow repeated adjustments to be made in the initial molding and in subsequent adjustments to suit different users or tools. Various thermoplastic elastomers, thermoplastic materials such as polyethylenes and polyurethanes, and plastics such as nylon can be used.

Alternatively, plastics and other similar materials may be hardened by utilizing some form of chemical catalyst as opposed to utilizing heat for hardening. Catalytic hardening includes the action of two-component polymer mixes such as epoxies. One product which has been found effective is "Half-Time Soft Putty," a vinyl polysiloxane dental impression material produced by admixing two components, available from Discus Dental, Inc. of Los Angeles. Another suitable material is "Apoxie® Sculpt", a two-part polymer molding compound available from Aves Co. of River Falls, Wis.

Any suitable type of marking media can be used in the writing instruments of the present invention. For example, ball point and roller ball pens, fountain pens, conventional pens using separate ink sources, "Speedball" type pens for fancy lettering or calligraphy, drafting pens, felt tip markers, highlighters, crayons, wooden or mechanical pencils, "grease" pencils, artists' pastels and chalks. For some of these marking media, attachment means as disclosed above for the tool holder can be used, if the item is too large to be placed inside the tube like the writing tips described above. FIG. 3B shows a conventional flexible ballpoint pen refill inserted into tube 10 and housing 13, with enough of tube 10 protruding from grip 14 to mate with a pen cap (not shown here). Flexible plastic refills are preferred to negotiate the curves of tubes 10 and 13.

Figure 9:
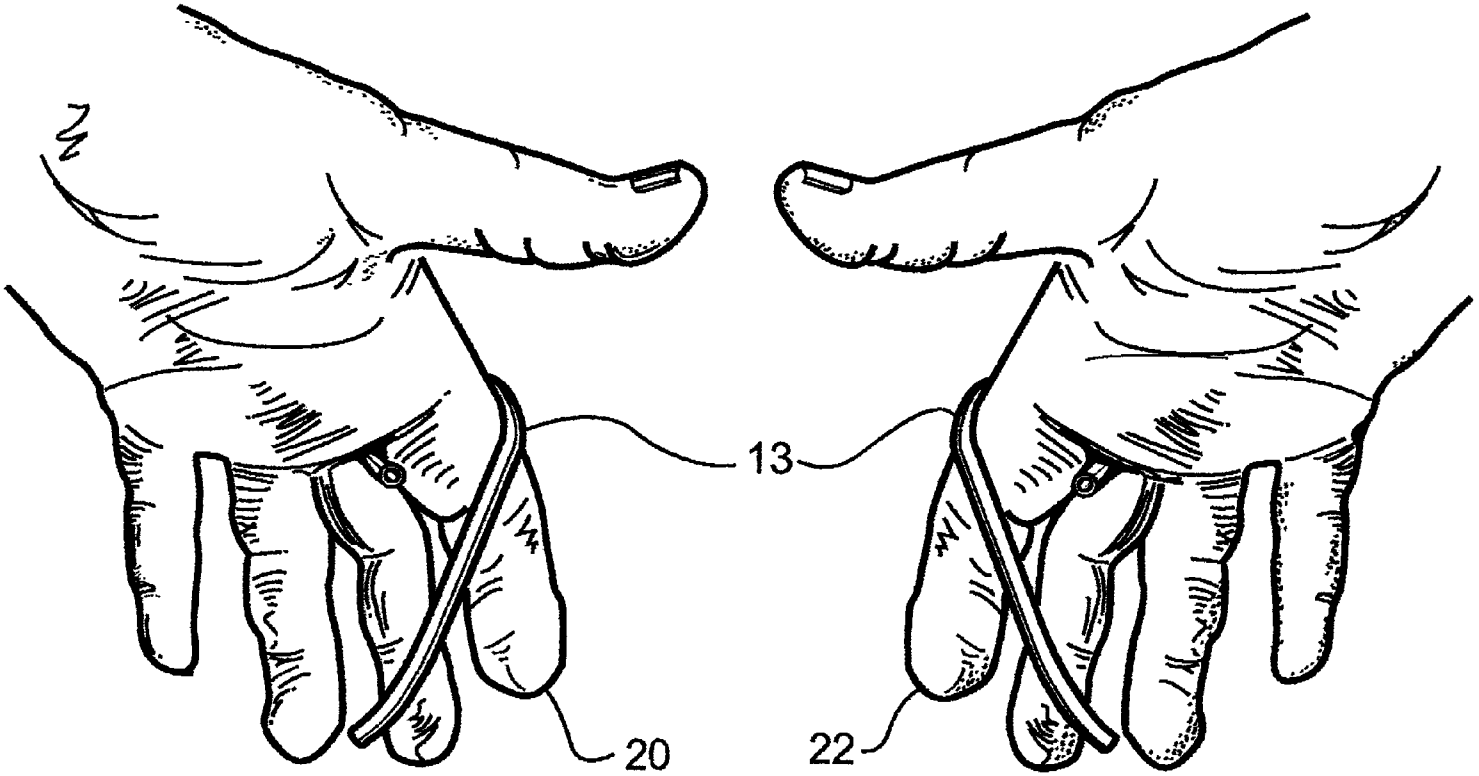
FIG. 9 illustrates the use of the writing instrument of the invention by right-handed and left-handed people.
Figure 9A:
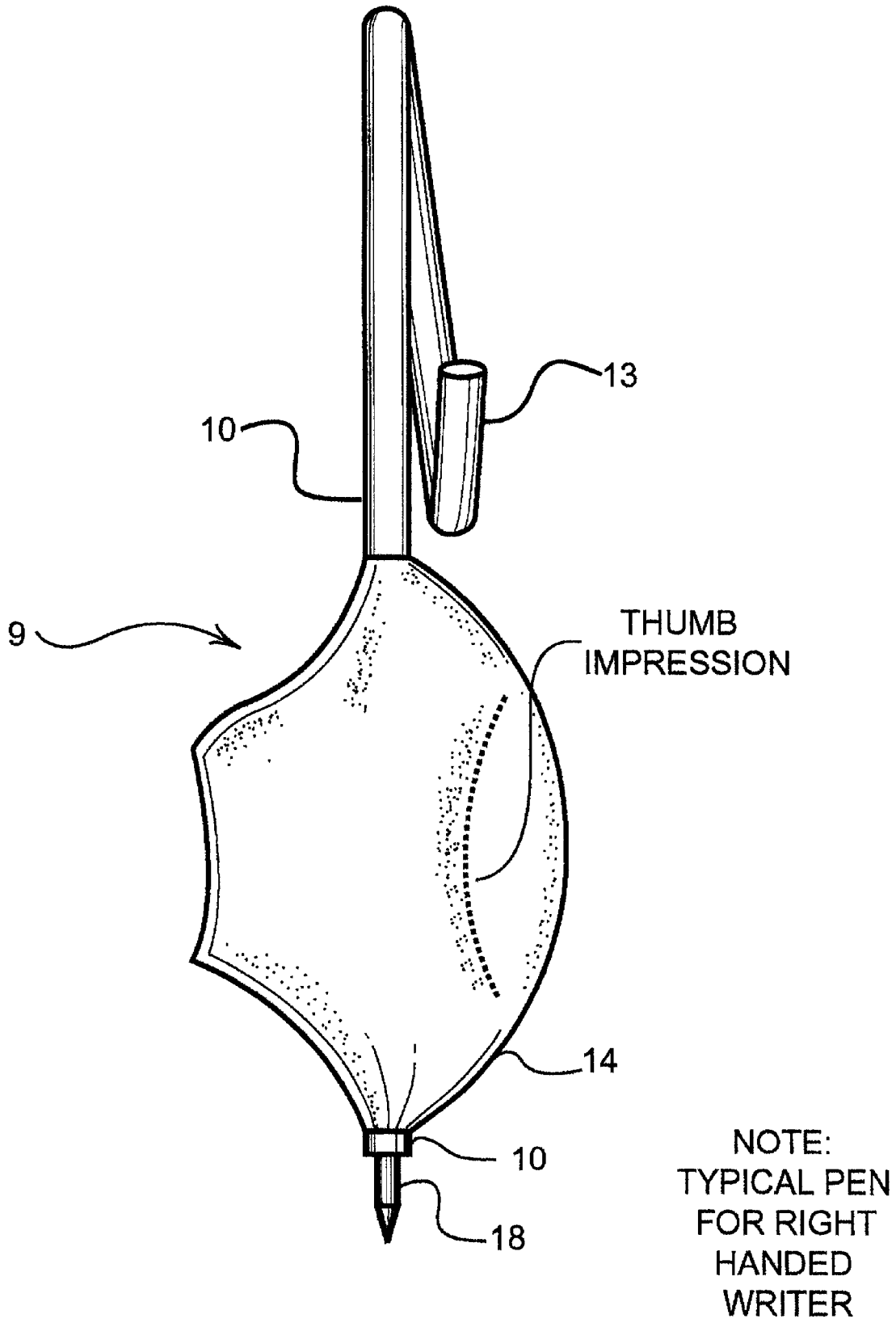
FIG. 9A is a side view of a writing instrument of the invention having a finger support loop and custom grip with impressions for thumb and fingers of a right handed user.

A method for creating an individual, custom designed writing instrument is provided as follows:

First, determine whether the user will hold the pen right or left-handed. As shown in FIG. 9, a left-handed user will normally poke the left index finger 20 through a loop in the tubing material which forms a backward letter "P", while a right-handed user will poke the right index finger 22 through a loop 13 describing the letter "P". (The kits for making tool holders and pens can be provided in right-handed or left-handed versions.) Alternatively, the user can adjust the tubing material for right or left handed use. FIG. 9A shows a pen with the tubing loop and impressions for the user's thumb and fingers in the grip, all configured for a right handed user. In some cases, it may desirable to use digits in addition to, or in alternative to, the index finger within this loop. The slight curve at the tip of the pen, shown in FIGS. 6 and 8, is designed so that the writing tip 18 is directed substantially "straight up and down" into the writing surface while the user's hand is held at its most comfortable angle. This is normally best for ballpoint pens. If necessary, the user can gently adjust this curve in the pre-bent tubing material to form the angle that gives the best results for that user. FIG. 6 illustrates a configuration which will be comfortable for most users. If the pen appears to be too short, the user may gently unroll and straighten out part of the looped portion of the pen to make the writing end long enough to fit the hand. At this stage, the user should gently open or close the loop to form a comfortable shape and diameter to fit the index finger and/or other fingers to be used in the grip.

The user should then prepare a lump of modeling compound large enough to form a comfortable grip, admixing different colors if desired for appearance. The tip of the pen is then thrust through the glob of modeling compound as shown in FIG. 6. Keeping the index and/or other fingers within the loop in the tubing material, the user presses the fingers to be used in the grip into the modeling compound to form concave areas to support the finger(s) while using the pen. When the grip is completely molded and comfortable to the user, the edges of the glob of modeling compound should be smoothed into fillets at 24 and 26 in FIG. 6. At least about ⅛ inch of the pen tubing should be left uncovered behind the pen tip to allow a pen cap 28 (See FIG. 3.) to be pressed on when the pen is not in use. Pen caps may be used at either or both ends when the pen will not be used for some time. Such pen caps can be made of elastomeric materials such as rubber or plastics, or can be formed of metal or rigid plastics to snap into place over the protruding portion of tube 10.

The user should try some writing with the molded pen to ensure that the grip is satisfactory. When it is certain that no improvements are needed, the molded grip can be hardened. Some clays can be hardened by simple exposure to air and sunlight for a day or two. With some thermosetting clays and modeling compounds, the completed pen can be boiled or baked to harden the molded grip. Preferably, the pen is boiled to harden the material. After ensuring that the pen caps are tight on each end, the complete assembly is immersed in boiling water for at least about 4 minutes, preferably by being suspended from a string or stick. With some modeling compounds, boiling produces a more desirable finish in the hardened grip. If possible, the ballpoint refill should be removed before baking; otherwise, first putting caps on both ends of the tubing material (if it contains a ballpoint pen refill), the pen can be baked in an oven for a period of at least about 10 to 40 minutes at a temperature in the range of from about 200 to 400 deg. F.

After the pen assembly has cooled, the pen caps can be removed and the pen tested, as shown in FIGS. 4 and 5. If the hardened molding compound has a tendecy to slip or slide on the bent tubing material, it can be secured in place by using a bit of any glue suitable for metal to plastic or ceramic adhesion.

Any leftover modeling compound can be kept in the packaging to keep it moldable if another grip is to be made to replace or improve the original. With some air driable modeling compounds, it is best to store them in an airtight container. The exposed tubing can be wrapped with colorful tape, thread, cord or the like for decorative purposes. The hardened grip can be used after the ballpoint refill runs out of ink by sliding out the old refill or even the tubing material and inserting the new. However, it is nearly as simple to form a new molded grip around the new refill assembly.

Figure 10:
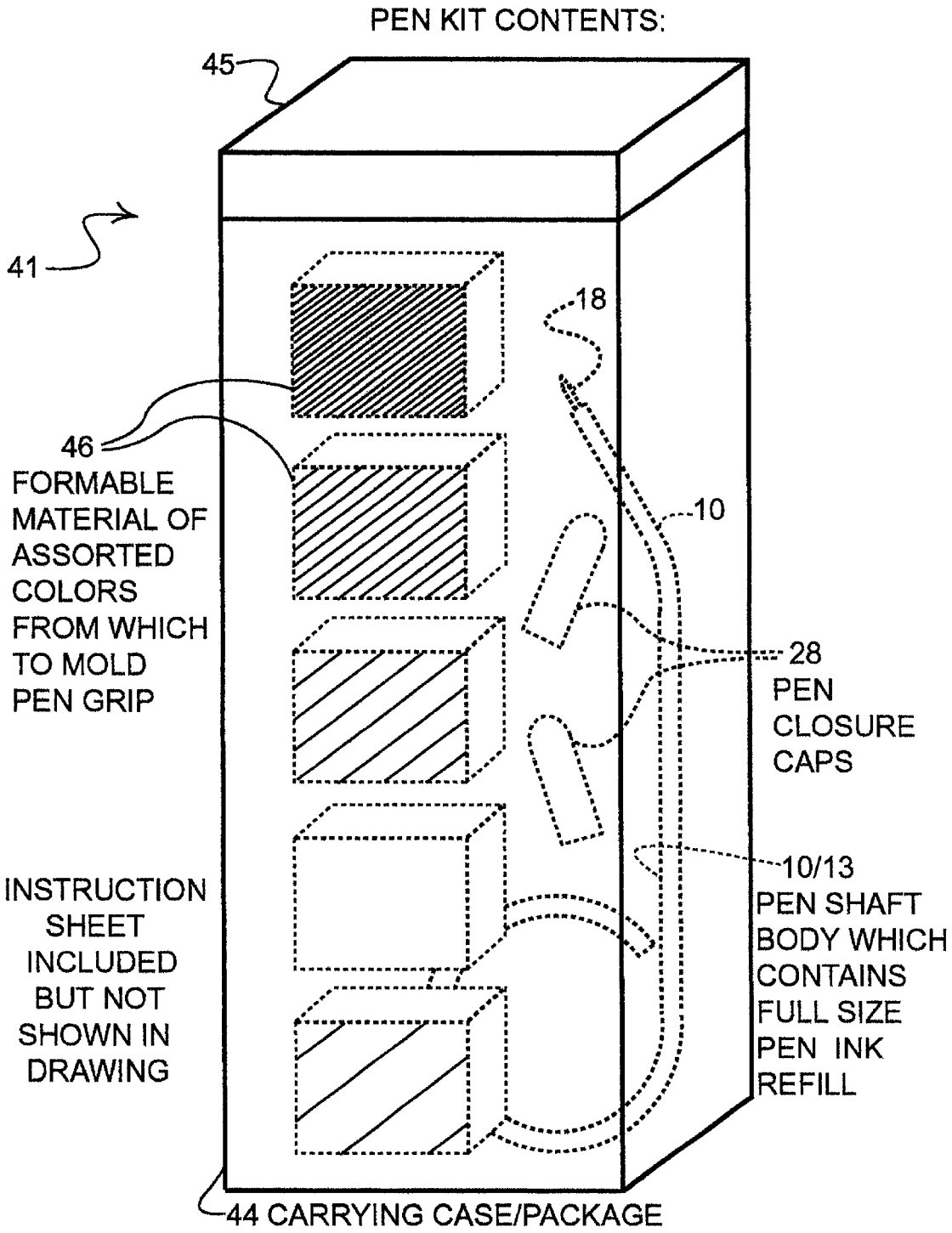
FIG. 10 is a perspective phantom view which illustrates the arrangement of the components of the writing instrument kit packed in a container-carrying case.
Figure 11:
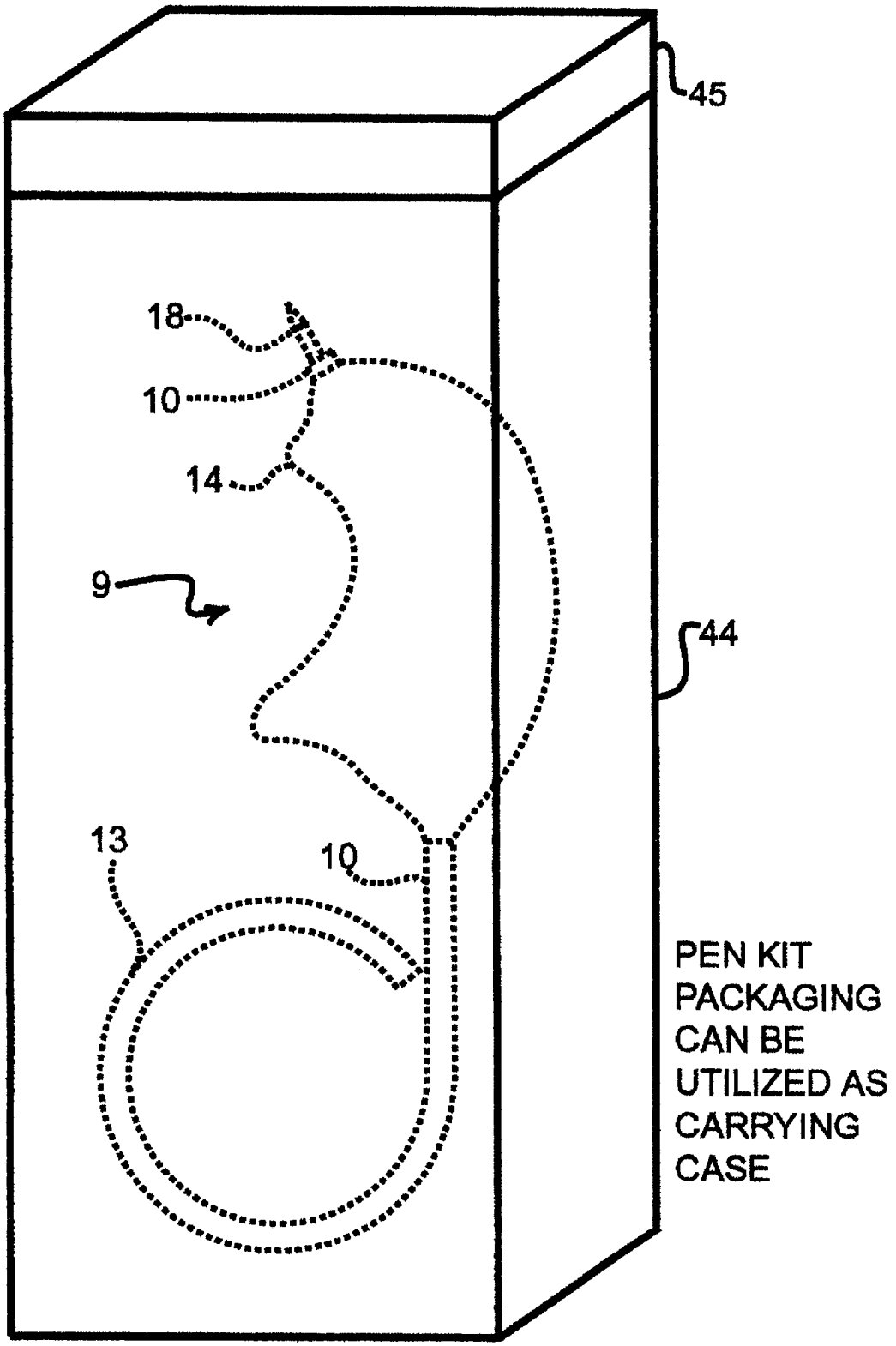
FIG. 11 is a perspective phantom view which illustrates the use of the kit box as a carrying case for a completed writing instrument.

FIG. 10 illustrates a kit 41 for assembling a custom-fitted writing instrument packaged in a rectangular box 44 with a lid 45. The kit contains at least one block 46 of formable modeling compound, preferably several blocks in different colors. Tubing 10 and finger support housing 13 are provided, loaded with a ballpoint refill (not shown) with pen tip 18. As described above, a single tube 10 can be used as an alternative to separate components 10 and 13. Spare ballpoint (or other type) refills can be provided. At least two pen closure caps 28 are provided. The rectangular box 44 in which the materials for the pen kit are provided can also be used as a carrying case for the completed pen, spare materials and any other writing instruments which the user carries, as shown in FIG. 11.

Figure 12:
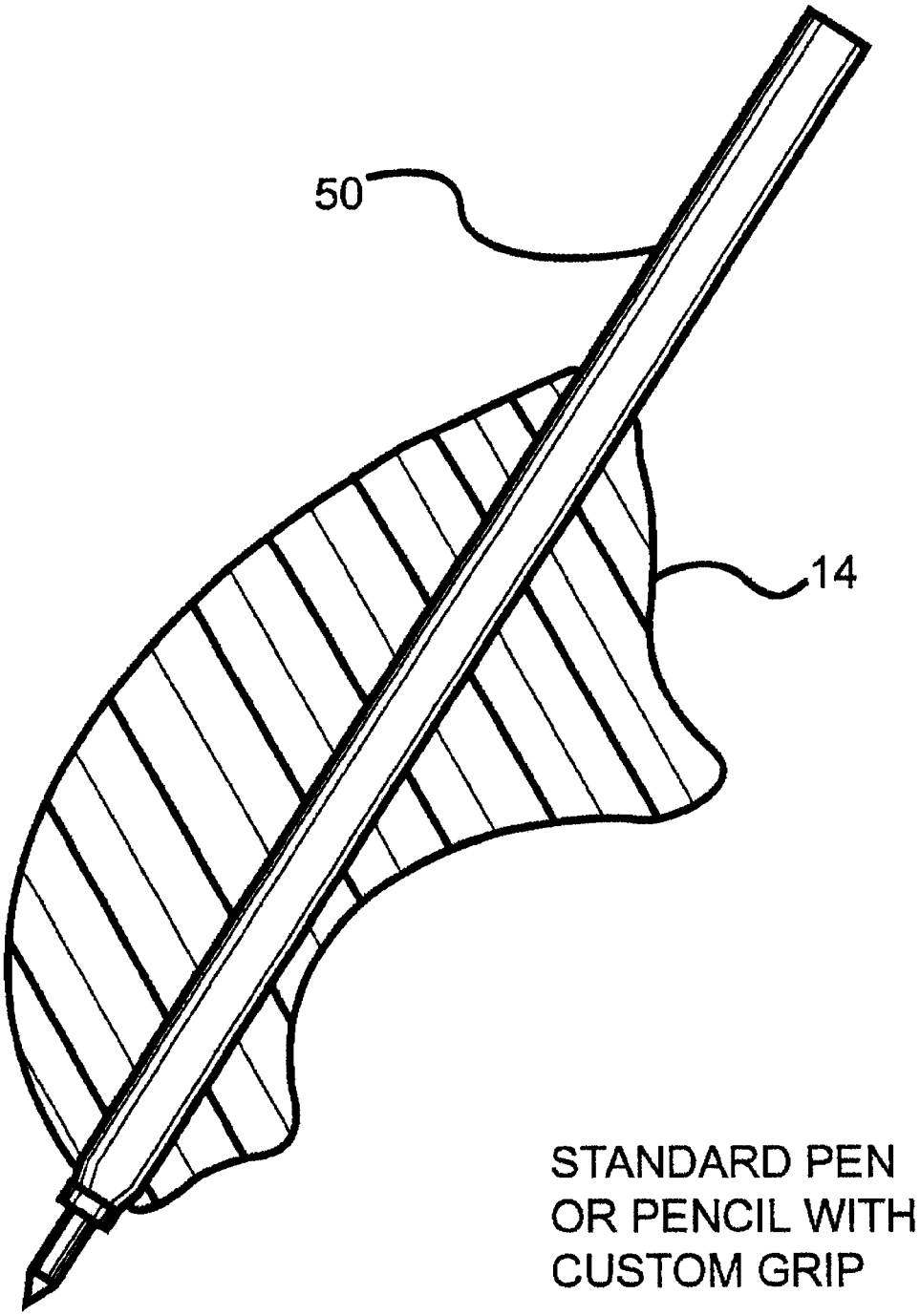
FIG. 12 is a side sectional view of a writing instrument having a custom-molded grip but no loop for the fingers

FIG. 12 illustrates a writing instrument 50 which is provided with a custom-molded grip 14 matching the user's fingers and grip orientation, as described above for other embodiments. This illustrates that the custom-molded grips disclosed above can be beneficial even without the finger support housing produced by bending a loop into the rod or tubing described above. The molded grip can also be used with various small hand tools such as hobby knives, surgical and dental instruments and applicators for paint and the like. If such grips are used on wooden pencils, crayons or other marking media which grow shorter as they are sharpened, the molded grip can be shifted to a new position and glued in place.

Figure 13:
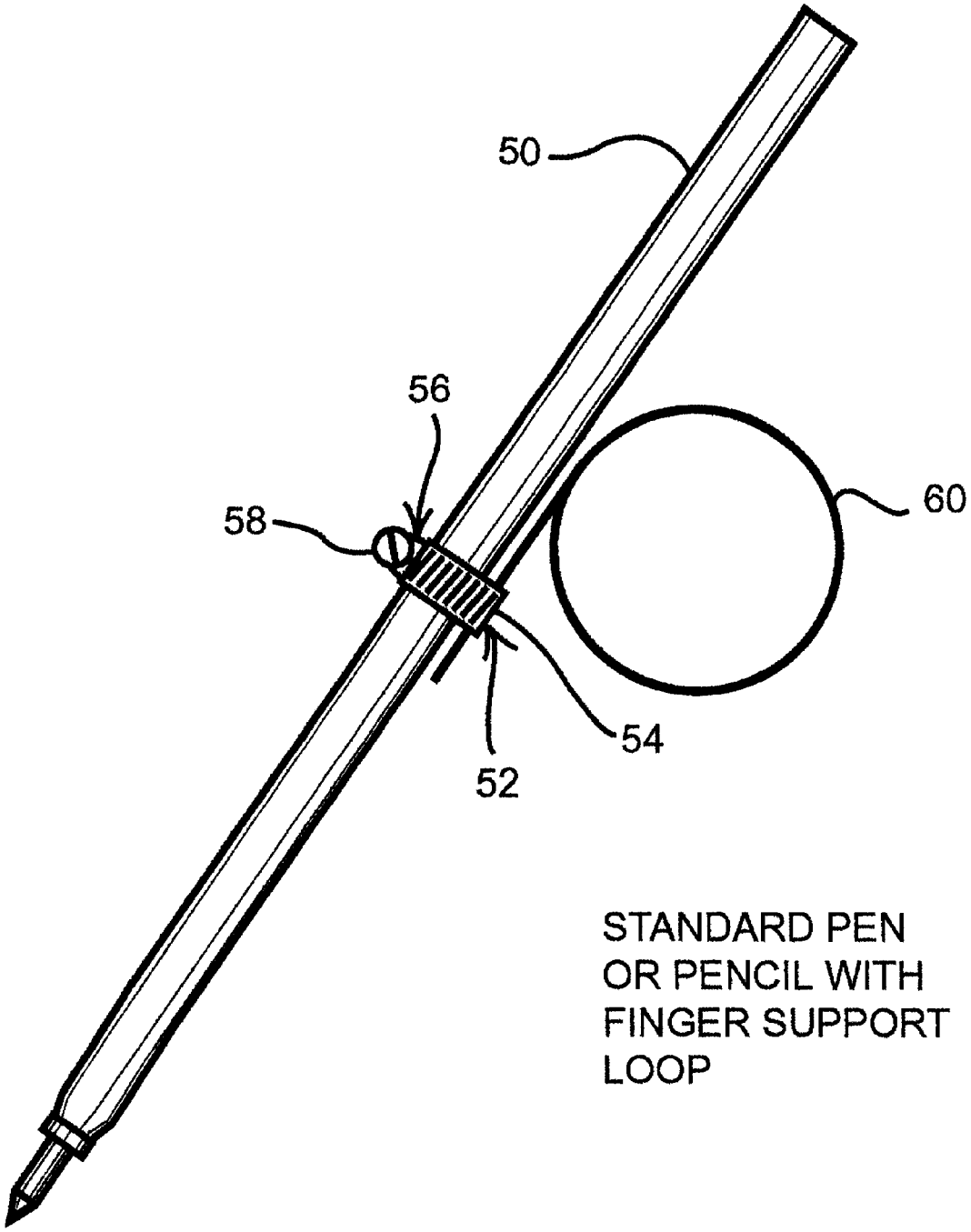
FIG. 13 is a side view of a writing instrument without a molded grip but having a bendable rod mechanically fastened to the barrel and formed into a loop to support at least one of the user's digits.

FIG. 13 illustrates a similar writing instrument 50 without the custom-fitted grip but using a finger support housing 60 which is removably fastened to the barrel of writing instrument 50 by compression means 52. FIG. 13 shows a small hose clamp 53 serving as the compression means, with a strap 54 and screw apparatus 56 tightened by screw 58; however any suitable device may be used which clamps one end of the wire or rod forming finger support housing 13 securely but removably to the barrel of the writing instrument 50. The orientation of the support housing and the size and positioning of the loop 60 are produced by the user, as described above. Surprisingly, even without the custom-molded grip, the finger support housing is found to help to support the writing instrument or other tool and improve the user's fine motor control in the use thereof.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications.

What is claimed is:

1. A custom-fitted hand tool holder, comprising:

a substantially longitudinal bendable rod material having a first end and a second end;

means for attaching a tool, interconnected to said first end of said rod material;

a piece of formable modeling compound disposed around and positioned between said first end and said second end of said rod material and adapted for conforming to the shape and size of a specific user's fingers and grip orientation.

2. The hand tool holder of claim 1 wherein said second end of said rod material has a loop shape adapted for wrapping around at least one digit of the hand of the user of said tool holder.

3. The hand tool holder of claim 2 wherein said digit is the index finger.

4. The hand tool holder of claim 1, further comprising a tool selected from the group consisting of writing sources, scribes, styluses, knives, dental and surgical instruments, felt-tip markers, paint applicators, glue applicators, electrical contacts and thermal devices, said tool being removably attached to said means for attaching a tool.

5. The hand tool holder of claim 4 which comprises a pen.

6. The hand tool holder of claim 4 which comprises a pencil.

7. The tool holder of claim 1 wherein said moldable modeling compound is hardened into a permanent fitted configuration.

8. The tool holder of claim 1 wherein said moldable modeling compound is a thermoplastic material which is heated and molded when soft into a permanent fitted configuration.

9. The tool holder of claim 1 wherein said tool attachment means comprise devices selected from the group consisting of blade mounting swivel heads, frictional sleeves, grooves combined with elastic bands and threaded couplings.

10. The tool holder of claim 1 wherein said tool attachment means comprise a tool collet assembly.

11. The too holder of claim 1 wherein said tool attachment means comprises two tubular components of different diameters fastened together longitudinally, the smaller tube being attached to said first end of said rod material and the larger tube accomodating the handle of a hand tool, wherein both tubes are tightened by compressive mechanical means.

12. A method for creating a custom fitted writing instrument, comprising the steps of:

providing a flexible tubing material capable of holding a marking medium;

shaping a piece of formable modeling compound around said tubing material in a manner which custom fits said formable modeling compound to the fingers and grip orientation of a user of said writing instrument while in a position of writing; and hardening said formable modeling compound to a degree which prevents said formable modeling compound from permanently deforming during use of the writing instrument.

13. The method of claim 12, wherein said formable modeling compound comprises a clay material.

14. The method of claim 12, wherein said hardening step comprises boiling the writing instrument and formed modeling compound in water for a period of time effective to harden said modelling compound.

15. The method of claim 12, wherein said hardening step comprises heating said formable modeling compound to a temperature of between about 200° F. and 400° F. for a time effective to harden it permanently.

16. The method of claim 12, wherein said hardening step comprises drying said formable modeling compound at an ambient temperature for a time effective to harden said compound.

17. The method of claim 12, wherein said hardening step comprises adding a chemical catalyst to said formable material.

18. The method of claim 12, wherein said formable modeling compound is a thermoplastic material which is heated to softness before molding, then hardened by cooling.

19. The method of claim 12, further comprising the step of shaping said tubing material into a finger support housing around at least one digit of the user's writing hand.

20. The method of claim 19 wherein said digit includes the user's index finger.

21. The method of claim 19, wherein said finger support housing comprises a bendable rod or tubing material capable of forming a loop.

22. The method of claim 21 wherein said bendable rod or tubing material of said finger support housing is slidably connected to the end of said tubing material opposite said marking medium to permit adjustments in length.

23. The method of claim 12, wherein said flexible tubing material comprises aluminum or plastic.

24. A custom fitted writing instrument produced by the method of claim 12.

25. A custom fitted writing instrument, comprising;

a substantially longitudinal flexible tubing material having a first end and a second end;

a writing source positioned inside said flexible tubing material and interconnected to a writing tip which extends beyond said first end of said flexible tubing material for contact with a writing surface; and a piece of formable modeling compound disposed around and positioned between said first end and said second end of said flexible tubing material which is adapted for conforming to the shape, size and grip orientation of a user's fingers and then hardened.

26. The custom fitted writing instrument of claim 25, wherein said second end of said flexible tubing comprises a loop shape adapted for wrapping around at least one digit of the writing hand of a user of said writing instrument.

27. The custom fitted writing instrument of claim 26 wherein said tubing comprising said loop is a separate component slidably attached to the portion of said tubing comprising the writing tip to facilitate length adjustments.

28. The custom fitted writing instrument of claim 25, wherein said second end of said flexible tubing is substantially linear and adapted for interconnecting to various decorative materials.

29. A kit for assembling and fitting a custom-fitted writing instrument, comprising:

a substantially longitudinal flexible tubing material having a first end and a second end;

a writing medium positioned inside said flexible tubing material and interconnected to a writing tip which extends beyond said first end of said flexible tubing material for contact with a writing surface when assembled;

a piece of formable modeling compound sufficient for disposing around and positioning between said first end and said second end of said flexible tubing material and molding to the shape and size of a user's fingers and grip orientation before hardening;

containment means for said modeling compound;

packaging means adapted for shipment, display and sale of said kit; and instructions for assembling said writing instrument and molding to the shape of a user's fingers and grip orientation.

30. The kit of claim 29 wherein said packaging means provide a carrying case for the completed custom fitted writing instrument.

31. The kit of claim 29 wherein said tubing material is provided as two components which can be slidably connected to allow for length adjustments by the user.

32. The kit of claim 29 wherein said formable modeling compound is a thermosetting material.

33. The kit of claim 29 wherein said formable modeling compound is a catalytically curable plastic and said kit further comprises a catalytic curing agent.

34. The kit of claim 29 wherein said moldable modelling compound is a thermoplastic material.

35. A kit for assembling and fitting a custom-fitted tool holder, comprising:

a substantially longitudinal bendable rod material having a first end and a second end;

at least one tool attachment means adapted for attachment to the first end of said rod material;

a plurality of tools adapted for mounting in said tool attachment means and selected from the group consisting of knives, surgical and dental instruments, scribes, styluses, paint applicators, thermal tips and electrical contacts;

a piece of formable modeling compound sufficient for disposing around and positioning between said first and and said second end of said bendable rod material and molding to the shape, size and grip orientation of the user's fingers;

containment means for said modeling compound;

packaging means for shipment, display and sale of said kit; and instructions for assembling said tool holder, molding to the shape of a user's fingers and grip orientation and for the use of said tools.

36. A writing instrument comprising a grip formed of modeling compound and a loop of bendable material adjustably attached near the grip in a position to accomodate at least one digit of the user's writing hand to provide support during use.

* * * * *